US007385339B2

(12) United States Patent
Lineton et al.

(10) Patent No.: US 7,385,339 B2
(45) Date of Patent: Jun. 10, 2008

(54) IGNITION DEVICE HAVING A REFLOWED FIRING TIP AND METHOD OF MAKING

(75) Inventors: Warran Boyd Lineton, Ann Arbor, MI (US); Karina C. Havard, Toledo, OH (US); James D. Lykowski, Temperance, MI (US)

(73) Assignee: Federal Mogul World Wide, Inc., Southfield, MI (US)

( * ) Notice: Subject to any disclaimer, the term of this patent is extended or adjusted under 35 U.S.C. 154(b) by 345 days.

(21) Appl. No.: 11/196,120

(22) Filed: Aug. 3, 2005

(65) Prior Publication Data

US 2006/0028106 A1 Feb. 9, 2006

Related U.S. Application Data

(60) Provisional application No. 60/598,288, filed on Aug. 3, 2004.

(51) Int. Cl.
*H01T 1/24* (2006.01)
*H01T 13/20* (2006.01)
*H01T 21/00* (2006.01)

(52) U.S. Cl. ..... 313/141; 313/143; 313/144; 445/7; 123/169 EL; 29/33 N; 140/71.5

(58) Field of Classification Search ..... 219/121.6–121.66; 445/7; 123/169 EL; 313/141–145; 140/71.5; 29/33 N
See application file for complete search history.

(56) References Cited

U.S. PATENT DOCUMENTS 3,075,066 A 1/1963 Yenni et al. ..... 219/76
3,673,452 A 6/1972 Brennen ..... 313/141
3,854,067 A 12/1974 Morgan ..... 313/130
4,081,710 A 3/1978 Heywood et al. ..... 313/141
4,122,366 A 10/1978 von Stutterheim et al. . 313/141
4,743,793 A 5/1988 Toya et al. ..... 313/141
4,786,267 A 11/1988 Toya et al. ..... 445/7
4,826,462 A 5/1989 Lenk ..... 445/7
5,395,273 A * 3/1995 Matsutani ..... 445/7
5,448,130 A * 9/1995 Matsutani et al. ..... 313/141
5,461,210 A 10/1995 Matsutani et al.
5,461,275 A 10/1995 Oshima ..... 313/141
5,461,276 A 10/1995 Matsutani et al.
5,736,809 A 4/1998 Matsutani et al.
5,779,842 A 7/1998 Fawcett et al. ..... 156/250
5,973,443 A 10/1999 Chang et al.
5,977,695 A 11/1999 Osamura et al.
5,990,602 A 11/1999 Katoh et al. ..... 313/141
6,071,163 A 6/2000 Chang et al.
6,093,071 A 7/2000 Osamura et al.
6,094,000 A 7/2000 Osamura et al.
6,132,277 A 10/2000 Tribble et al. ..... 445/7
6,232,704 B1 5/2001 Herweg et al. ..... 313/141

(Continued)

*Primary Examiner*—Mariceli Santiago
(74) *Attorney, Agent, or Firm*—Robert L. Stearns; Dickinson Wright PLLC

(57) ABSTRACT

A sparkplug having ground and center electrodes that include a firing tip formed from a noble metal or noble metal alloy by reflowing of a noble metal preform. The present invention also includes a method of manufacturing a metal electrode having an ignition tip for an ignition device, including forming a metal electrode having a firing tip portion; applying a noble metal preform to the firing tip portion; and reflowing the noble metal preform to form a noble metal firing tip.

46 Claims, 17 Drawing Sheets

U.S. PATENT DOCUMENTS

| | | | | |
|---|---|---|---|---|
| 6,262,522 | B1 | 7/2001 | Osamura et al. | |
| 6,265,815 | B1 | 7/2001 | Reznik | 313/141 |
| 6,304,022 | B1 | 10/2001 | Matsutani | |
| 6,412,465 | B1 | 7/2002 | Lykowski et al. | 123/169 |
| 6,533,629 | B1 | 3/2003 | Boehler et al. | |
| 6,611,083 | B2 | 8/2003 | LaBarge et al. | 313/140 |
| 6,614,145 | B2 | 9/2003 | Fleetwood et al. | 313/141 |
| 6,676,468 | B2 | 1/2004 | Ishiguro et al. | |
| 6,724,133 | B2 | 4/2004 | Miyashita et al. | 313/143 |
| RE38,536 | E | 6/2004 | Reznik | 313/141 |
| 6,844,662 | B2 | 1/2005 | Morita et al. | |
| 6,885,135 | B2 | 4/2005 | Kanao et al. | |
| 6,885,136 | B2 | 4/2005 | Orjela et al. | |
| 6,971,937 | B2 | 12/2005 | Menken et al. | |
| 2002/0171346 | A1 | 11/2002 | Ulm et al. | 313/141 |

* cited by examiner

FIG - 10
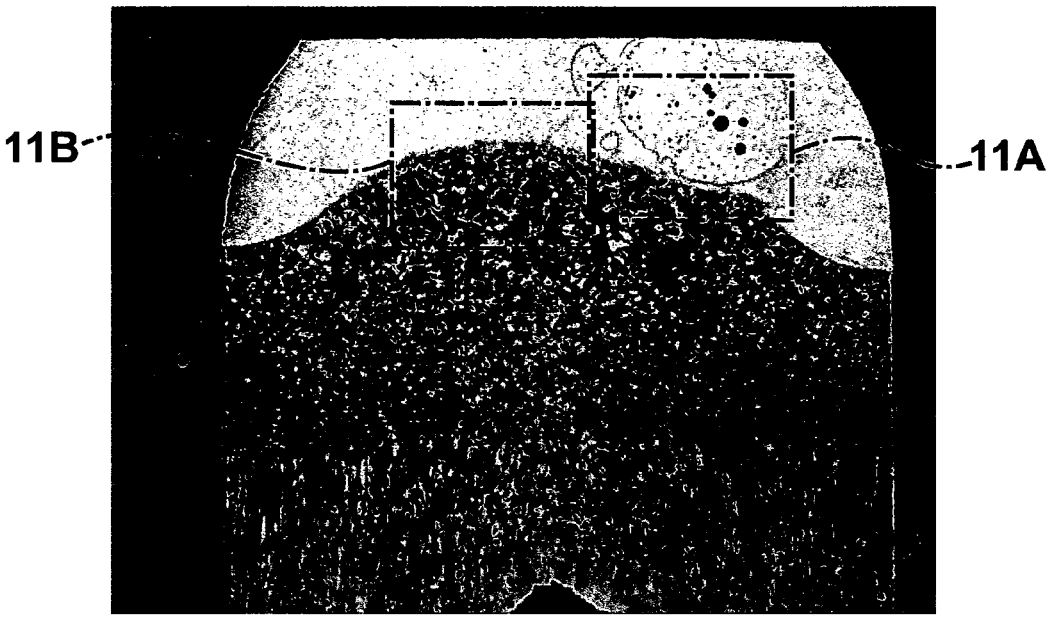
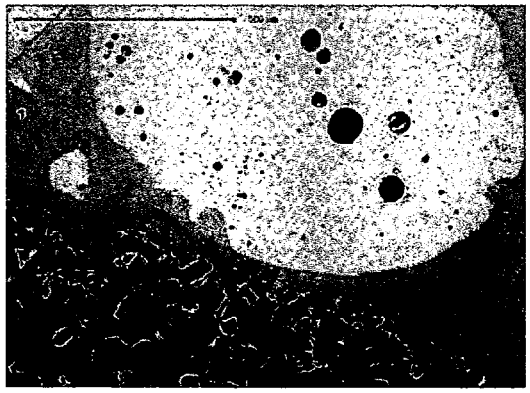
FIG - 11A
FIG - 11B
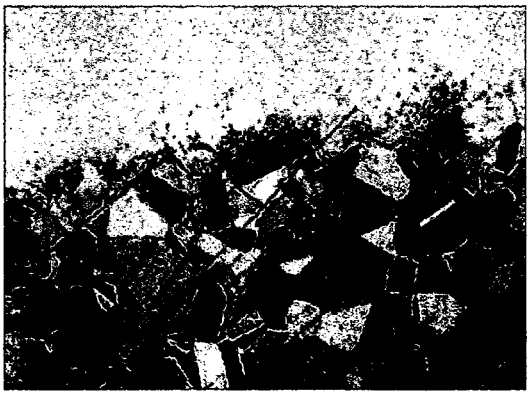

FIG - 12
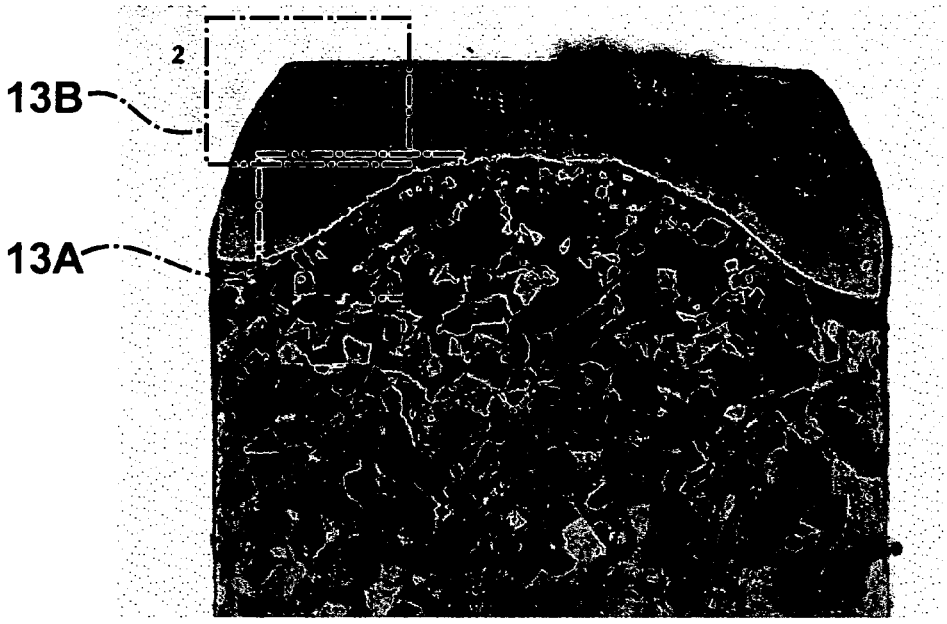
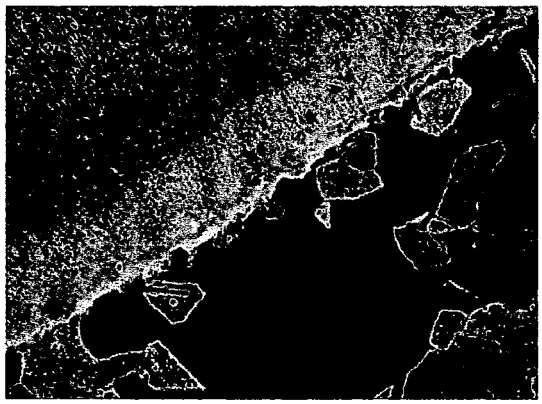
FIG - 13A
FIG - 13B
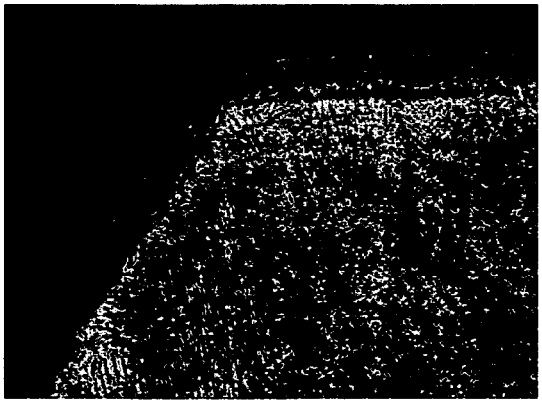

Weight of Ir/Rh/W added to Ni electrode before and after fusing

Ir/Rh/W on Ni electrode, 0.5s laser shot

Ir/Rh/W on Ni electrode, 0.6s laser shot

Ir/Rh/W on Ni electrode, 0.7s laser shot

Ir/Rh/W on Ni electrode, 0.8s laser shot

Ir/Rh/W on Ni electrode, 1s laser shot

Top view of 0.030" end diameter electrode with fused Iridium

Side view of 0.030" end diameter electrode with fused Iridium

Top view of 0.060" end diameter electrode with fused Iridium

Side view of 0.060" end diameter electrode with fused Iridium

Section view of 0.060" end diameter electrode with fused Iridium

Asymmetric reflowed Iridium on Ni electrode, scanned beam

Ni electrode with reflowed Iridium on tip, single laser shot with rotation of electrode Ni electrode with reflowed Iridium on tip, after grind and polish Section of Ni electrode with as-reflowed Iridium on tip Section of reflowed Ni electrode after grind and polish Pt reflowed on Ni electrode without mask, side view Pt fused on nickel pin without mask, top view Pt reflowed on Ni electrode with mask, top view Pt reflowed on Ni electrode with mask, side view Pt reflowed on Ni electrode with mask, top view Pt reflowed on Ni electrode with flat end, Spun in beam for 0.7s Pt reflowed on Ni electrode with drilled end, Spun in beam for 0.5s Top view, Ir reflowed on Ni alloy ground electrode with one slurry coat and one pass of scanned beam Ni alloy ground electrode (uncoated)

Ni alloy ground electrode, first slurry coating

Ni alloy ground electrode, first reflow

Ni alloy ground electrode, second slurry coating

Ni alloy ground electrode, second reflow

IGNITION DEVICE HAVING A REFLOWED FIRING TIP AND METHOD OF MAKING

CROSS-REFERENCES TO RELATED APPLICATIONS

This patent application claims priority to U.S. Provisional Patent Application Ser. No. 60/598,288, filed Aug. 3, 2004, which is hereby incorporated herein by reference in its entirety.

BACKGROUND OF THE INVENTION

1. Technical Field

This invention relates generally to sparkplugs and other ignition devices used in internal combustion engines and, more particularly, to such ignition devices having noble metal firing tips. As used herein, the term "ignition device" shall be understood to include sparkplugs, igniters, and other such devices that are used to initiate the combustion of a gas or fuel.

2. Related Art

Within the field of sparkplugs, there exists a continuing need to improve the erosion resistance and reduce the sparking voltage at the sparkplug's center and ground electrode, or in the case of multi-electrode designs, the ground electrodes. To this end, various designs have been proposed using noble metal electrodes or, more commonly, noble metal firing tips applied to standard metal electrodes. Typically, the firing tip is formed as a pad or rivet or wire which is then welded onto the end of the electrode.

Platinum and iridium alloys are two of the noble metals most commonly used for these firing tips. See, for example, U.S. Pat. No. 4,540,910 to Kondo et al. which discloses a center electrode firing tip made from 70 to 90 wt % platinum and 30 to 10 wt % iridium. As mentioned in that patent, platinum-tungsten alloys have also been used for these firing tips. Such a platinum-tungsten alloy is also disclosed in U.S. Pat. No. 6,045,424 to Chang et al., which further teaches the construction of firing tips using platinum-rhodium alloys and platinum-iridium-tungsten alloys.

Apart from these basic noble metal alloys, oxide dispersion strengthened alloys have also been proposed which utilize combinations of the above-noted metals with varying amounts of different rare earth metal oxides. See, for example, U.S. Pat. No. 4,081,710 to Heywood et al. In this regard, several specific platinum and iridium-based alloys have been suggested which utilize yttrium oxide ($Y_2O_3$). In particular, U.S. Pat. No. 5,456,624 to Moore et al. discloses a firing tip made from a platinum alloy containing <2% yttrium oxide. U.S. Pat. No. 5,990,602 to Katoh et al. discloses a platinum-iridium alloy containing between 0.01 and 2% yttrium oxide. U.S. Pat. No. 5,461,275 to Oshima discloses an iridium alloy that includes between 5 and 15% yttrium oxide. While the yttrium oxide has historically been included in small amounts (e.g., <2%) to improve the strength and/or stability of the resultant alloy, the Oshima patent teaches that, by using yttrium oxide with iridium at >5% by volume, the sparking voltage can be reduced.

Further, as disclosed in U.S. Pat. No. 6,412,465 B1 to Lykowski et al. it has been determined that reduced erosion and lowered sparking voltages can be achieved at much lower percentages of yttrium oxide than are disclosed in the Oshima patent by incorporating the yttrium oxide into an alloy of tungsten and platinum. The Lykowski patent teaches an ignition device having both a ground and center electrode, wherein at least one of the electrodes includes a firing tip formed from an alloy containing platinum, tungsten, and yttrium oxide. Preferably, the alloy is formed from a combination of 91.7%-97.99% platinum, 2%-8% tungsten, and 0.01%-0.3% yttrium, by weight, and in an even more preferred construction, 95.68%-96.12% platinum, 3.8%-4.2% tungsten, and 0.08%-0.12% yttrium. The firing tip can take the form of a pad, rivet, ball, wire, or other shape and can be welded in place on the electrode.

While these and various other noble metal systems typically provide acceptable sparkplug performance, particularly with respect to controlling the spark performance and providing spark erosion protection, current sparkplugs which utilize noble metal tips have well-known performance limitations associated with the methods which are used to attach the noble metals components, particularly various forms of welding. In particular cyclic thermal stresses in the operating environments associated with the use of the sparkplugs, such as those resulting from the mismatch in thermal expansion coefficients between the noble metals and noble metal alloys mentioned above which are used for the electrode tips and the Ni, Ni alloy and other well-known metals which are used for the electrodes, are known to result in cracking, thermal fatigue and various other interaction phenomena that can result in the failure of the welds, and ultimately of the sparkplugs themselves. Therefore, it is highly desirable to develop sparkplugs having noble metal firing tips which have improved structures, particularly microstructures, so as to improve sparkplug performance and reliability by alleviating or eliminating potential failure mechanisms associated with related art devices. It is also highly desirable to develop methods of making sparkplugs which will achieve these performance and reliability improvements.

SUMMARY OF THE INVENTION

The present invention is an ignition device for an internal combustion engine, including a housing; an insulator secured within said housing and having an exposed axial end at an opening in said housing; a center electrode mounted in said insulator and extending out of said insulator through said axial end, said center electrode including a firing tip formed from a reflowed noble metal preform; and a ground electrode mounted on said housing and terminating at a firing end that is located opposite said firing tip such that said firing end and said firing tip define a spark gap therebetween.

The noble metal is preferably selected from a group consisting of iridium, platinum, palladium, rhodium, gold, silver and osmium, and alloys thereof. In another embodiment of the invention, the noble metal also comprises a metal from the group consisting of tungsten, yttrium, lanthanum, ruthenium and zirconium as an alloying addition.

The electrode may also include a recess that is adapted to receive a noble metal preform.

The present invention also is a method of manufacturing a metal electrode having an ignition tip for an ignition device, including the steps of: forming a metal electrode having a firing tip portion; applying a noble metal preform to the firing tip portion; and reflowing the noble metal preform to form a noble metal firing tip. The method may also include a step of forming a recess in the electrode that is adapted to receive a noble metal preform.

BRIEF DESCRIPTION OF THE DRAWINGS

These and other features and advantages of the present invention will become more readily appreciated when considered in connection with the following detailed description and appended drawings, wherein like features have been given like reference numerals, and wherein:

FIG. 10 is a an optical photomicrograph of a metallographic section of an electrode of the present invention having a reflowed noble metal firing tip;

FIGS. 11A and 11B are optical photomicrographs of regions 11A and 11B of the metallographic section of FIG. 10;

FIG. 12 is a an optical photomicrograph of a metallographic section of an electrode processed under the same conditions as the electrode of FIG. 10 after annealing at 900° C. for 24 hours;

FIGS. 13A and 13B are optical photomicrographs of regions 13A and 13B of the metallographic section of FIG. 12;

DETAILED DESCRIPTION OF THE PREFERRED EMBODIMENT

Figure 1:
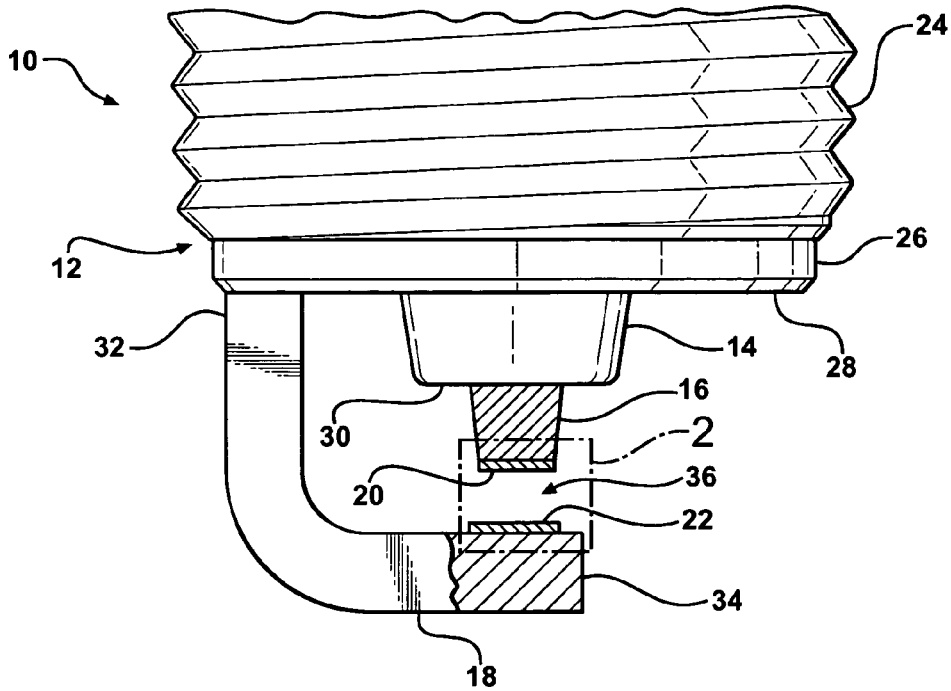
FIG. 1 is a fragmentary view and a partially cross-sectional view of a sparkplug constructed in accordance with a preferred embodiment of the invention.

Referring to FIG. 1, there is shown the working end of a sparkplug 10 that includes a metal casing or housing 12, an insulator 14 secured within the housing 12, a center electrode 16, a ground electrode 18, and a pair of firing tips 20, 22 located opposite each other on the center and ground electrodes 16, 18, respectively. Housing 12 can be constructed in a conventional manner as a metallic shell and can include standard threads 24 and an annular lower end 26 to which the ground electrode 18 is welded or otherwise attached. Similarly, all other components of the sparkplug 10 (including those not shown) can be constructed using known techniques and materials, excepting of course the ground and/or center electrodes 16, 18 which are constructed with firing tips 20 and/or 22 in accordance with the present invention, as will be described further below.

As is known, the annular end 26 of housing 12 defines an opening 28 through which insulator 14 protrudes. Center electrode 16 is permanently mounted within insulator 14 by a glass seal or using any other suitable technique. Center electrode 16 may have any suitable shape, but commonly is generally cylindrical in shape having an arcuate flair or taper to a larger diameter on the end opposite firing tip 20 which is housed within insulator 14 (see FIG. 3). T his characteristic shape facilitates seating and sealing within insulator 14. Center electrode 16 generally extends out of insulator 14 through an exposed, axial end 30. Center electrode 16 may be made from any suitable conductor as is well-known in the field of sparkplug manufacture, such as various Ni and Ni-based alloys, and may also include such materials clad over a Cu or Cu-based alloy core. Ground electrode 18 is illustrated in the form of a conventional arcuate ninety-degree elbow of generally rectangular cross-sectional shape that is mechanically and electrically attached to housing 12 at one end 32 and that terminates opposite center electrode 16 at its other end 34. This free end 34 comprises a firing end of the ground electrode 18 that, along with the corresponding firing end of center electrode 16, defines a spark gap 36 therebetween. However, it will be readily understand that ground electrode 18 may have a wide variety of shapes and sizes, such as where the housing is extended further so as to generally surround center electrode 16, such that ground electrode 18 may be generally straight extending from lower end 26 of housing 12 to center electrode 16 so as to define spark gap 36. As will also be understood, firing tips 20 may be placed on the end or sidewall of center electrode 16, and firing tip 22 may be placed as shown or on the free end 34 of ground electrode 18 such that spark gap 36 may have many different arrangements and orientations. Firing tips 20,22 are placed on the firing end of electrodes 16,18 on firing tip portions of these surfaces.

Figure 2A:
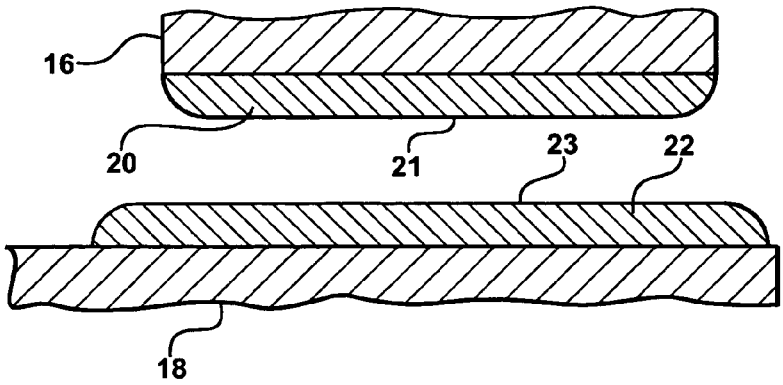
FIG. 2A is cross-sectional view of a first embodiment of region 2 of the sparkplug of FIG. 1.
Figure 2B:
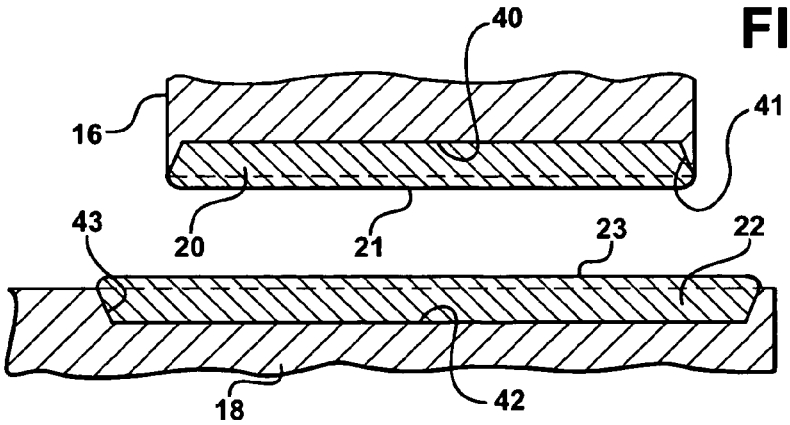
FIG. 2B is cross-sectional view of a second embodiment of region 2 of the spark plug of FIG. 1.

The firing tips 20, 22 are each located at the firing ends of their respective electrodes 16, 18 so that they provide sparking surfaces for the emission and reception of electrons across the spark gap 36. As viewed from above the firing tip surfaces 21, 23, of firing tips 20, 22 may have any suitable shape, including rectangular, square, triangular, circular, elliptical, polygonal (either regular or irregular) or any other suitable geometric shape. These firing ends are shown in cross-section for purposes of illustrating the firing tips which, in this embodiment of the invention, comprise noble metal pads reflowed into place on the firing tips. As shown in FIG. 2A, the firing tips 20, 22 can be reflowed onto the surface of electrodes 16, 18, respectively. Alternately, as shown in FIG. 2B, the firing tips 20, 22 can be reflowed into recesses 40, 42 respectively, provided in one or both of the surfaces of electrodes 16, 18, respectively. Any combination of surface reflowed and recess reflowed center and ground electrodes is possible. One or both of the tips can be fully or partially recessed on its associated electrode or can be reflowed onto an outer surface of the electrode without being recessed at all. When the firing tip is reflowed into a recess 40, 42 on the electrode, the recess formed in the electrode prior to reflow of the firing tip may be of any suitable cross-sectional shape, including rectangular, square, triangular, circular or semicircular, elliptical or semi-elliptical, polygonal (either regular or irregular), arcuate (either regular or irregular) or any other suitable geometric shape. The sidewalls 42 of the recess may be orthogonal to the firing tip surface, or may be tapered, either inwardly or outwardly. Further, the sidewall 44 profile may be a linear or curvilinear profile. As such, recess 40 may have virtually any overall three-dimensional shapes, including simple box-shapes, various frustoconical, pyramidal, hemispherical, hemielliptical and other shapes. Firing tips 20, 22 may be of the same shape and have the same surface area, or they may have different shapes and surface areas. For example, it may be desirable to make firing tip 22 such that it has a larger surface area than firing tip 20 in order to accommodate a certain amount of axial misalignment of the electrodes in service without negatively affecting the spark transmittance performance of sparkplug 10. It should be noted that is possible to apply firing tips of the present invention to just one of electrodes 16, 18, however, it is known to be preferred to apply noble metal alloys as firing tips 20, 22 to both of electrodes 16, 18, in order to enhance the overall performance of sparkplug 10, particularly, its erosion and corrosion resistance at the firing ends. Except where the context requires otherwise, it will be understood that references herein to firing tips 20,22 may be to either or both of firing tips 20 or 22.

Figure 3:
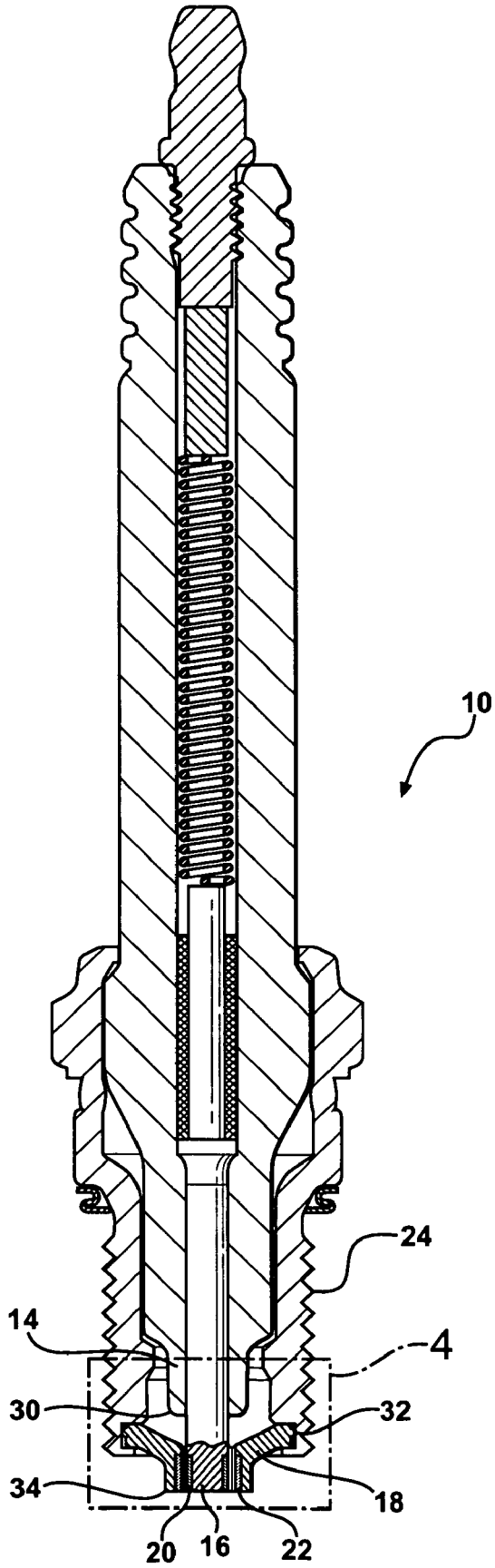
FIG. 3 is a cross-sectional view of a sparkplug constructed in accordance with a second preferred embodiment of the invention.
Figure 4:
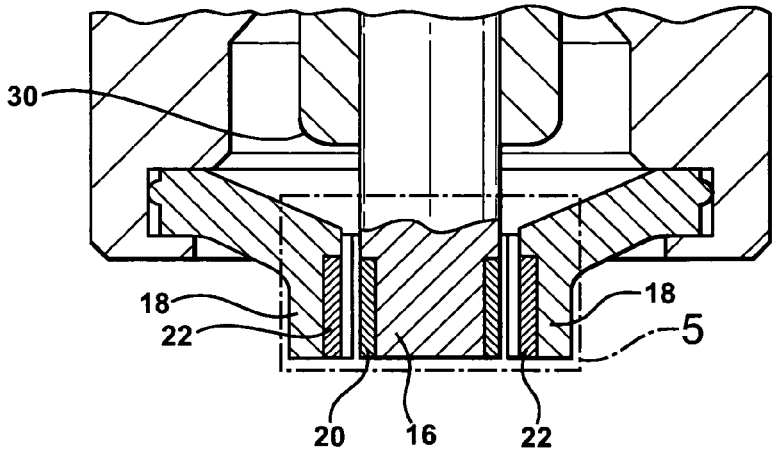
FIG. 4 is a cross-sectional view of region 4 of the sparkplug of FIG. 3.
Figure 5A:
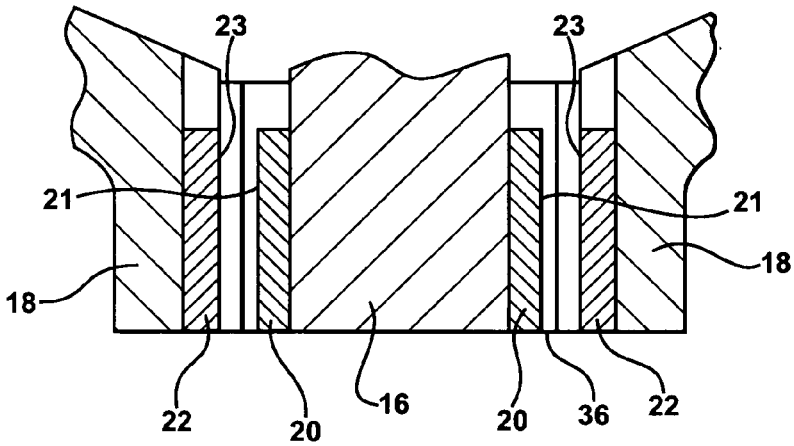
FIG. 5A is a cross-sectional view of one embodiment of region 5 of region 4 of the sparkplug of FIG. 3.
Figure 5B:
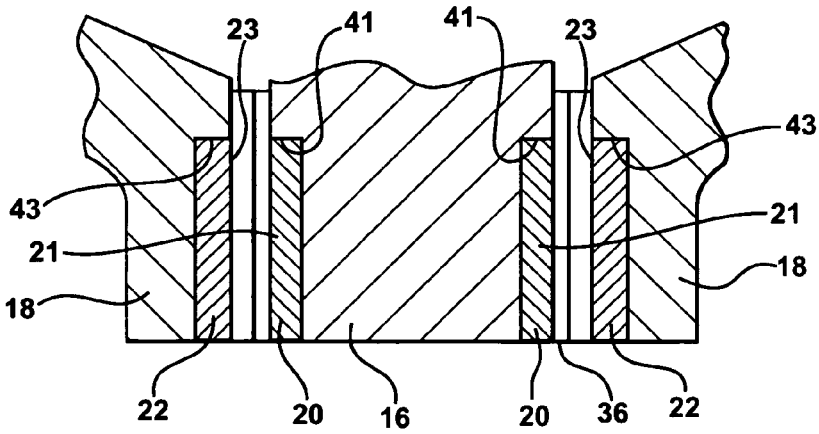
FIG. 5B is a cross-sectional view of a second embodiment of region 5 of region 4 of the sparkplug of FIG. 3

The reflowed electrodes of the present invention may also utilize other ignition device electrode configurations, such as the sparkplug electrode configurations illustrated in FIGS. 3-5. Referring to FIG. 3, a multi-electrode sparkplug 10 of construction similar to that described above with respect to FIGS. 1, 2A and 2B, is illustrated, wherein sparkplug 10 has a center electrode 16 having a firing tip 20 and a plurality of ground electrodes 18 having firing tips 22. The firing tips 20, 22 are each located at the firing ends of their respective electrodes 16, 18 so that they provide sparking surfaces for the emission and reception of electrons across the spark gap 36. These firing ends are shown in cross-section for purposes of illustrating the firing tips which, in this embodiment, comprise pads reflowed into place on the firing tips. The firing tips 20, 22 may be formed on the surface of the electrode as illustrated in FIG. 5A or in a recess as illustrated in FIG. 5B. The external and cross-sectional shapes of the recess may be varied as described above.

In accordance with the invention, each firing tip 20, 22 is formed from at least one noble metal from the group consisting of platinum, iridium, palladium, rhodium, osmium, gold and silver, and may include more than one of these noble metals in combination (e.g., all manner of Pt—Ir alloys). The firing tip having at least one noble metal may also comprise as an alloying constituent, at least one metal from the group consisting of tungsten, yttrium, lanthanum, ruthenium and zirconium. Further, it is believed that the present invention is suitable for u se with all known noble metal alloys used as firing tips for sparkplug and other ignition device applications, including the alloy compositions described in commonly assigned U.S. Pat. No. 6,412,465, to Lykowski et al., which is hereby incorporated herein by reference in its entirety, as well as those described, for example, in U.S. Pat. No. 6,304,022 (which describes certain layered alloy structures) and U.S. Pat. No. 6,346,766 (which describes the use of certain noble metal tips and associated stress relieving layers), which are herein incorporated by reference in their entirety.

Figure 9:
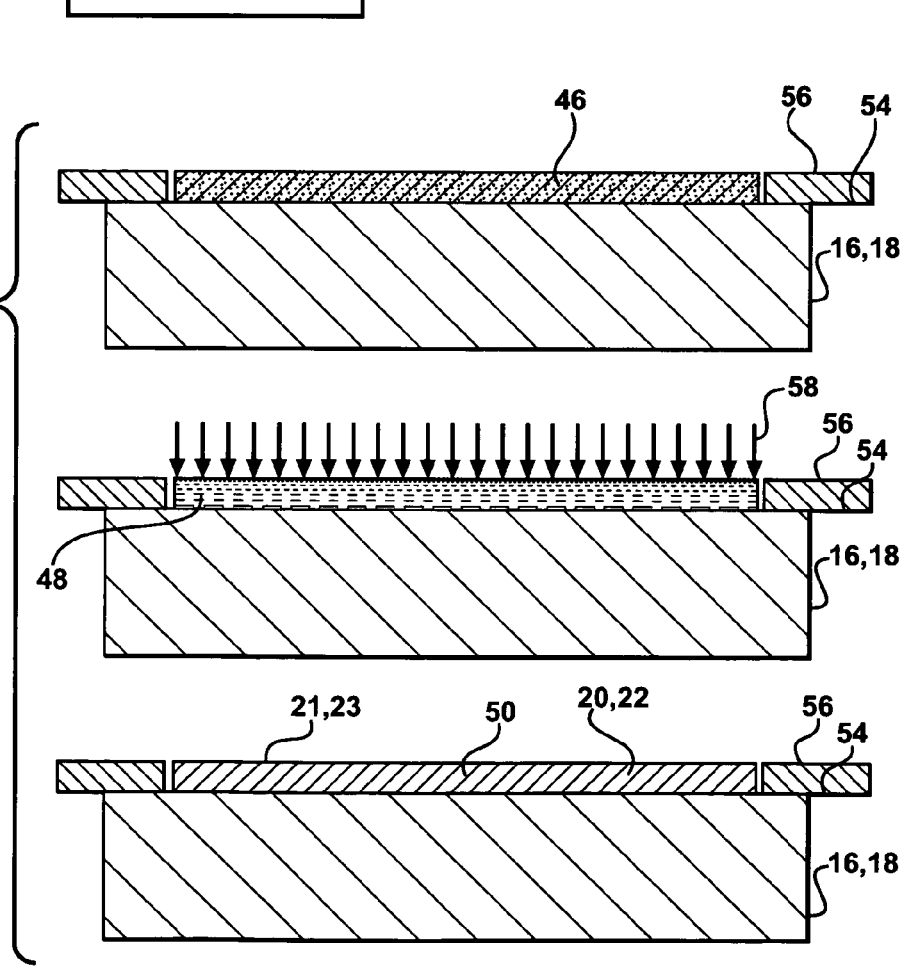
FIG. 9 is a schematic view of a third embodiment of step 160 of the method of the invention.
Figure 7:
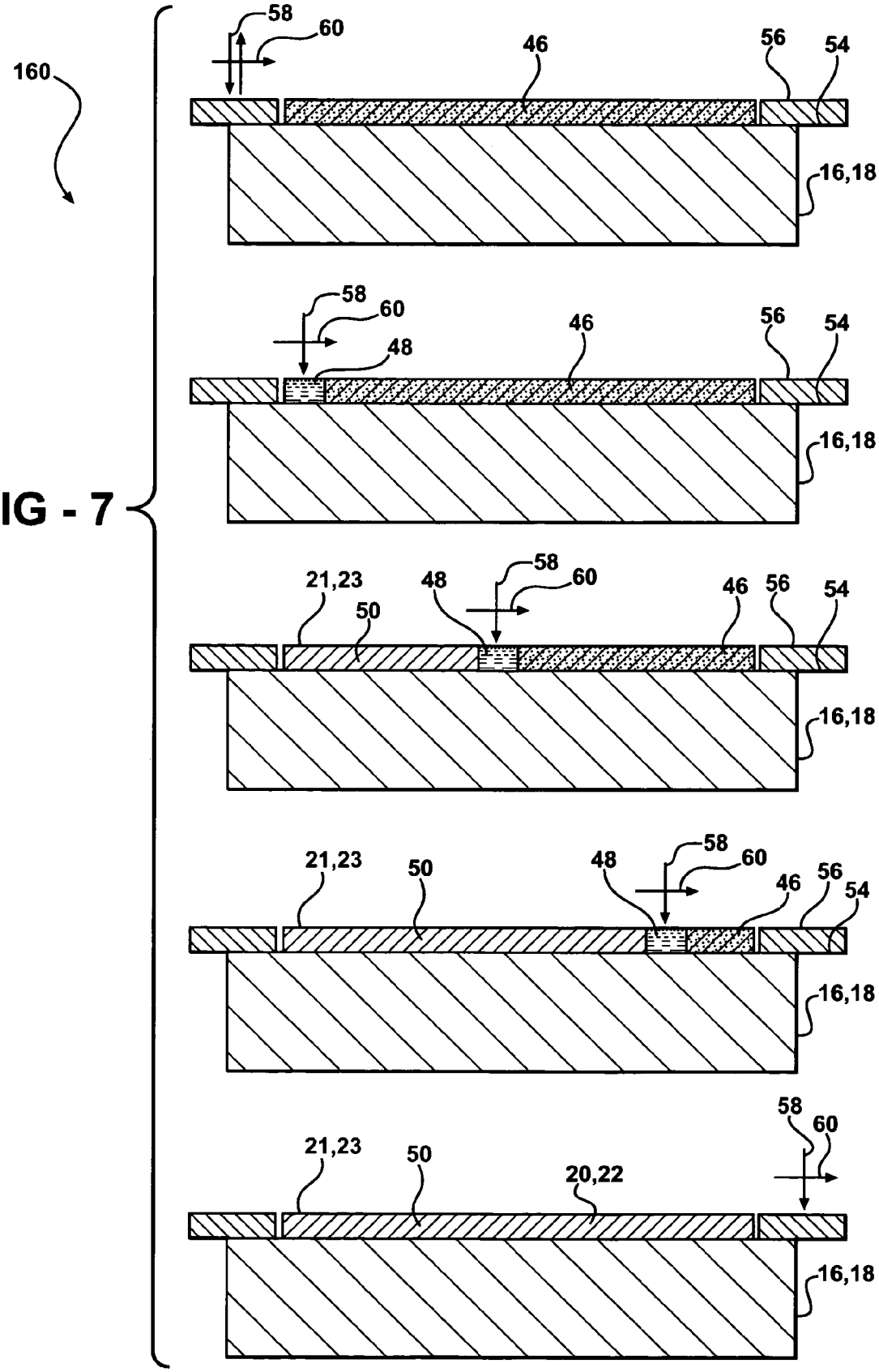
FIG. 7 is a schematic view of one embodiment of step 160 of the method of the invention.
Figure 8:
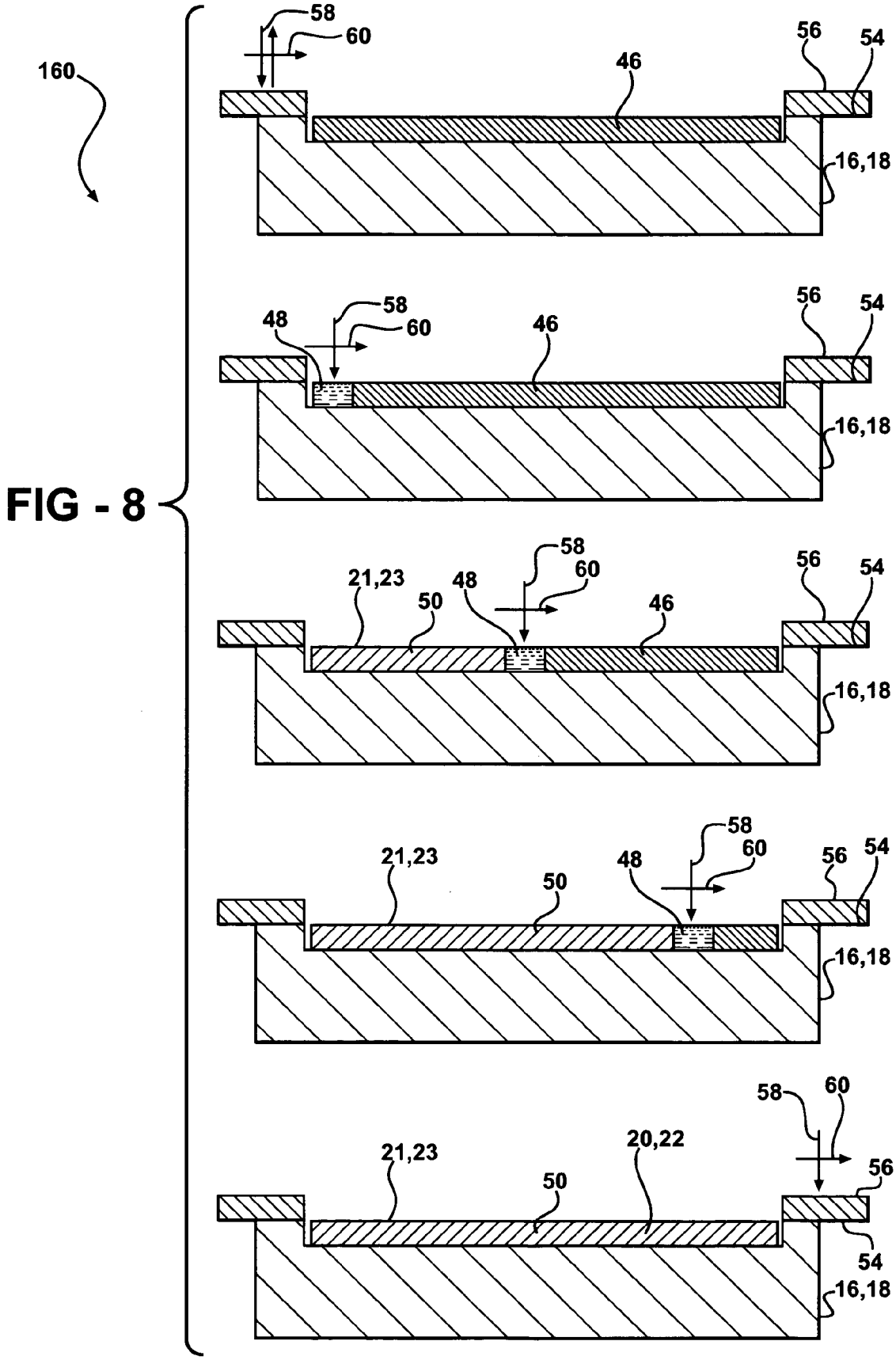
FIG. 8 is a schematic view of a second embodiment of step 160 of the method of the invention.
Figure 19A:
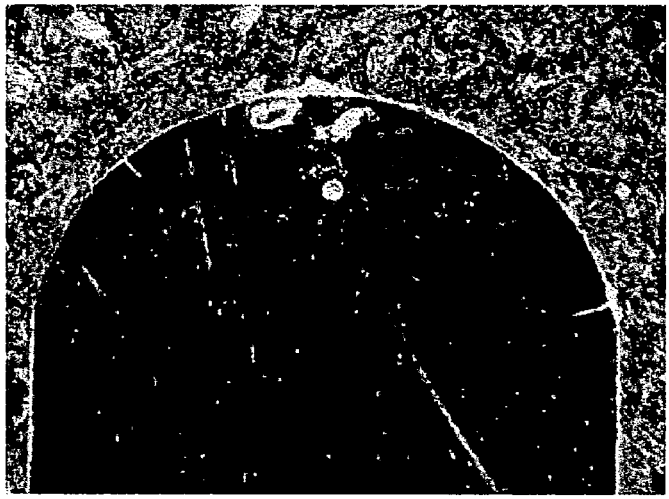
FIGS. 19A and B are optical photomicrographs of metallographic sections of electrode of the type of FIGS. 18B and C, respectively.
Figure 19B:
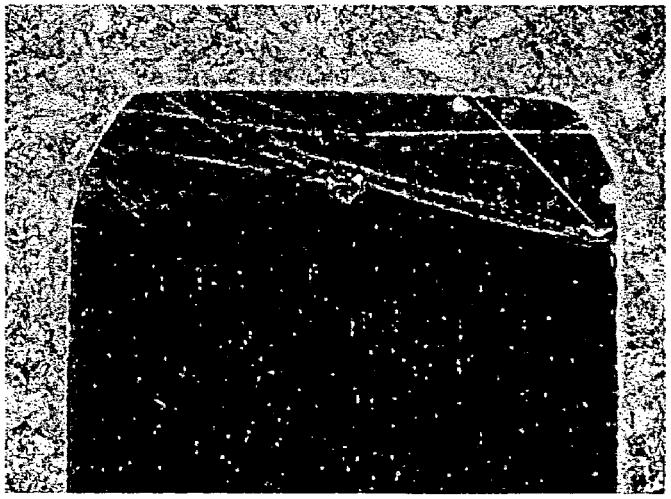
Figure 20A:
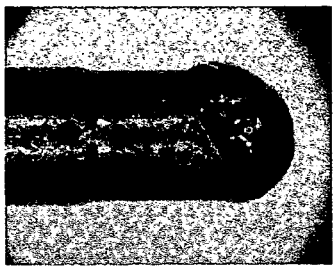
FIG. 20A is a side view photograph of an electrode of the present invention.
Figure 20B:
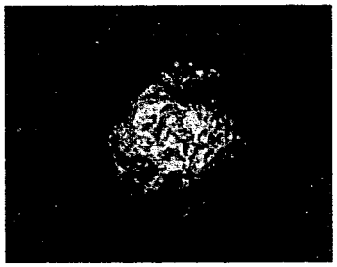
FIG. 20B is a top view photograph of the electrode of FIG. 20A.
Figure 20C:
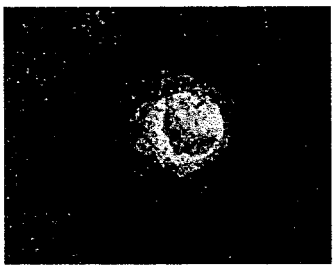
FIG. 20C is a top view photograph of an electrode of the present invention.
Figure 20D:
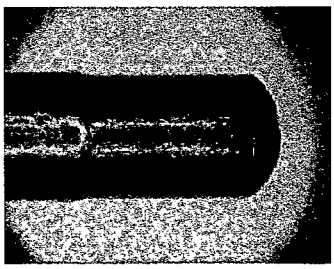
FIG. 20D is a side view photograph of an electrode of FIG. 20C.
Figure 20E:
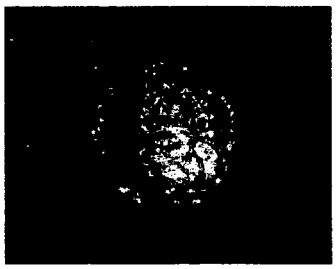
FIG. 20E is a top view photograph of the electrode of FIG. 20D.

Referring to FIGS. 7-9, the noble metal alloys of firing tips 20,22 are made by reflowing or melting an alloy preform 46 or multiple alloy preforms 46 of the desired noble metal alloy composition or multiple alloy compositions placed at the desired location of the firing tip 20,22 on the firing end of electrodes 16, 18 by application of a high intensity or energy density energy source 58, such as a laser or electron beam, as described herein. Alloy preform 46 may include pre-alloyed solid forms which have a predetermined shape, such as chips, rivets, caps or the like, or may utilize solid forms which do not have a predetermined shape, such as sheets, ribbons, wires or the like. Preferably, alloy preform 46 may also include various particulate or powder preforms, which may be applied in any of a number of well-known forms, including as a free flowing powder as might be applied into a recess, a compacted or sintered powder preform, a slurry of powder and various volatizable constituents or the like. The powder may be a pre-alloyed powder of a given noble metal alloy composition or a mixture of various metal powders sufficient to produce a desired noble metal alloy composition or microstructure when the various powder constituents are reflowed. Either of the solid or powder alloy preforms may also comprise composite structures, such as horizontal or vertical layered structures, or which include honeycombs, whiskers or filaments of materials which enhance erosion or corrosion resistance or electron emission or other spark enhancement characteristics. It is believed that they may also incorporate various non-conductive, non-noble elements or compounds to this end, including various ceramic materials. The localized application of energy source 58 is sufficient to cause at least partial melting of alloy preform 46 sufficient to produce at least a partial melt pool 48 in the area where energy source 58 is applied. The term at least partial melting is intended to have a broad meaning. It is distinguished from various welding processes as have been employed in the manufacture of various related art electrodes having noble metal alloy firing tips, as such processes generally produce melting in a heat affected zone only at an interface between the noble metal alloy and the base metal of the electrode and are employed so as to avoid generalized melting of the noble metal firing tip and the electrode. In the present invention, alloy preform 46 is at least partially melted through the thickness of the preform, and in many cases is completely melted through the thickness of the preform. For example, in the case of many solid preforms or pre-alloyed powder preforms, it may be desirable to completely melt the alloy preform 46, which will also result in localized melting of the electrode surface proximate the preform as the electrodes are typically formed from Ni or Ni-based alloys which have a melting point that is lower than the melting point of alloy preform 46. In the case of certain powder mixture preforms which are not pre-alloyed, it may be desirable to melt one or more of the alloy constituents while leaving one or more of the other alloy constituents unmelted or only partially melted or dissolved into the other alloy constituents. This characteristic allows the development of virtually limitless combinations of resolidified alloy microstructures 50, from homogeneous noble metal alloys to meta-stable mixtures of noble metals with other noble metal and non-noble metal constituents. This may be accomplished by suitable manipulation of the alloy preform constituents, their particle sizes (in the case of powder preforms) and control of the energy input as well as other factors. The microstructures of the firing tips 20,22 of the present invention are distinguished from the microstructures of welded firing tips. Because of the partial melting and the fact that the energy input and melt characteristics may be varied across the surface of alloy preform 46, the nature of the interface between resultant firing tips 20,22 and electrodes 16,18 may be controlled as to their shape, the extent of diffusion of constituents of the electrodes and alloy preforms into one another, grain size and morphology and other characteristics. As to the shape of the interface, as may be seen for example in FIGS. 10-13, the firing tip/electrode interface may be non-planar which is believed to reduce the propensity for crack propagation and premature failure in response to the thermal cycling experienced by the electrodes in service environments. As may be seen in FIGS. 10-13, 19A and 19B, the reflowed firing tip covers the firing end of the electrode completely and the interface between the firing tip and firing end is upwardly convex. Further, the outer surface forms a curved plane (FIG. 19A) and may be formed to establish a substantially flat plane (19B). As may also be seen in FIGS. 10-13, the width of the interface and the extent of diffusion may be controlled to provide a graded stress relieving zone having a variable coefficient of thermal expansion that varies as a function of the thickness through the interface in conjunction with the corresponding alloy composition variation. Further, the grain size and morphology may be controlled by suitable control of the heating and cooling of the melt zone 48. For example, it is believed that columnar or dendritic grain morphologies may be produced by suitable control of heating/cooling using well-known methods for controlling grain size and morphology. FIGS. 12 and 13 illustrate an electrode 20 which has been heated to 900° C. for 24 hours following reflowing which represents an extreme thermal cycle and the resultant good adherence and integrity of the firing tip.

The energy input 58 may be applied 60 as a scanned, rastered or stationary beam of an appropriate laser having a continuous or pulsed output, which is applied either on or off focus, depending on the desired energy density, beam pattern and other factors, as described herein. Because lasers having the necessary energy output to partially melt the alloy preforms 46 also have sufficient energy to cause melting of the electrode surface proximate the alloy preform 46, it is desirable to place a metal mask 54 having a polished surface 56 which is adapted to reflect the laser energy over those portions of the electrodes 16,18 proximate the alloy preforms 46, thereby generally limiting melting to the alloy preform 46, and potentially to portions of the electrode 16,18 proximate the alloy preform 46 and firing tips 20,22 if such melting is desired, by suitable sizing of the mask and configuration of alloy preform 46 and/or electrode 16,18.

Figure 6:
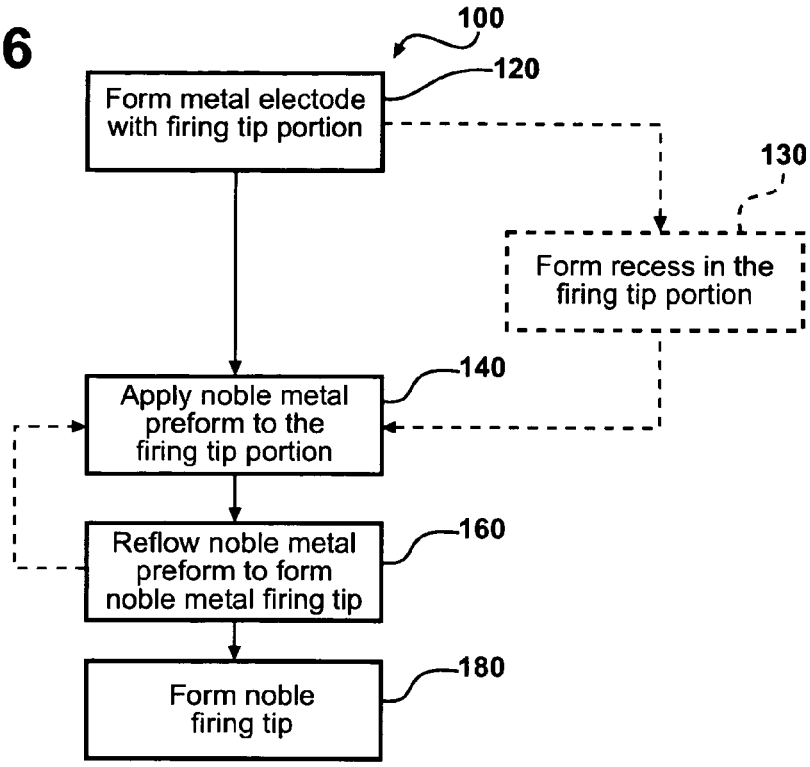
FIG. 6 is a schematic representation of the method 100 of the invention.

As illustrated in FIG. 6, the present invention also comprises a method 100 of manufacturing a metal electrode having an ignition tip for an ignition device, comprising the steps of: forming 120 a metal electrode 16,18 having a firing end and a firing tip portion; applying 140 a noble metal preform 46 to the firing tip portion; and reflowing 160 the noble metal preform 46 to form a noble metal firing tip 20,22. Method 100 may also optionally include a step of forming 130 a recess 40,42 in the metal electrode 16,18 prior to the step of applying 140 the noble metal preform 46, such that the noble metal preform 46 is located in the recess 132. Method may also optionally include a step of forming 180 the firing tip 20,22 following the step of reflowing 160. Further, the steps 140 and 160 may be repeated as shown in FIG. 6 to add additional material to firing tips 20,22, or to form firing tips 20,22 having multiple layers.

The step of forming 120 the metal electrode having a firing end and a firing tip portion may be performed using conventional methods for manufacturing both the center and the ground electrode or electrodes. These electrodes may be manufactured from conventional electrode materials used in the manufacture of sparkplug, for example, Ni and Ni-based alloys. Center electrodes 16 are frequently formed in a generally cylindrical shape as shown in FIG. 3, and may have a variety of firing tip configurations, including various necked d own cylindrical or rectangular tip shape. Ground electrodes 18 generally have rectangular cross-section and are in the form of straight bars, elbows and other shapes as are well-known in the art.

The step of forming 130 a recess 132 in the electrode may be performed by any suitable method of forming recesses in the electrodes, such as stamping, drawing, machining, drilling, abrasion, etching and other well-known methods of forming or removing material to create recess 40,42. Recess 40,42 may be of any suitable size and shape, including box-shapes, frusto-conical shapes, pyramids and others, as described herein.

The step of applying 140 the noble metal preform 46 to the firing tip portion may comprise any suitable process for applying a noble metal preform to the firing tip portion of the electrode 16,18. Noble metal preform 46 may include any suitable noble metal preform, such as, for example, noble metal wires, strips, tapes, blanks, foils and aggregated powder particles, as further described herein. The suitable step of applying 140 will depend on the type of noble metal preform selected. For example, in the case of wires, strips, tapes, blanks, and foils, well-known methods of applying these preforms may be applied, such as the use of adhesives, fluxes, tack welds, staking and other means for holding the preform materials in a fixed relation to the firing end and firing tip portion of the electrode sufficiently to enable the subsequent step of reflowing 160 the alloy preform to form the firing tip. In the case of an aggregate powder preform, the preform may be applied as a slurry or paste by dipping spraying, screen printing, doctor blading, painting or other methods of applying a slurry or paste to an electrode. An aggregate powder may also be applied as a pressed powder compact in a green form, such as by compacting a powder on the firing end of the electrode, or by placed a compacted or sintered powder compact into a recess 40,42.

Once the noble metal preform has been applied to the firing end of the electrode, method 100 continues with the step of reflowing 160 the noble metal preform to form the firing tip 20,22. Reflowing 160 may include melting all or substantially all of the noble metal preform, but must include melting at least a portion of the noble metal preform through the thickness of the preform, as described herein. Reflowing 160 is in contrast to prior methods of making firing tips using noble metal alloys, particularly those which employ various forms of welding and/or mechanical attachment, wherein a noble metal cap is attached to the electrode by very localized melting which occurs in the weld heat affected zone (i.e. the interface region between the cap and the electrode), but wherein all, or substantially all, of the cap is not melted. This difference produces a number of differences in the structure of, or which affect the structure of, the resulting firing tip. One significant difference is the shape of the resulting firing tip. Related art firing tips formed by welding tend to retain the general shape of the cap which is welded to the electrode. In the present invention, the melting of the noble metal preform permits liquid flow of the noble metal preform, which flow can be utilized to create various new shapes of the firing tip as it resolidifies. In addition, surface tension effects in the melt together with the design of the firing end of the electrode can be used to form any number of shapes which are either not possible or very difficult to obtain in related art devices. For example, if the electrode incorporates an undercut recess in the electrode, the melting of the noble metal preform can be utilized to create forms not possible with related art devices. Because of the well-known propensity of the noble metals and the electrode materials to interdiffuse, particularly at temperatures above the liquidus temperature of the noble metals, it is preferred that the step of reflowing 160 be performed so as to generally minimize the time associated with reflowing 160. It is preferred that the time be less than about 2 seconds. However, various combinations of alloy preform 46 and electrodes 16,18 are possible such that longer reflow times may be utilized.

The step of reflowing 160 is illustrated schematically in FIGS. 7-9. In FIG. 7, a scanned beam 58 is used to reflow a metal preform 46 that has been attached to the firing tip portion of electrode 16,18 so as to form firing tip 20,22 having a resolidified microstructure 50. FIG. 8 is similar to FIG. 7, except that the alloy preform 46 has been located in recess 40, 42. FIG. 9 is also similar to FIG. 7, except that the beam 58 is stationary rather than scanned; however, the electrode 20, 22 and/or mask 54 may be rotated under the stationary beam.

In order to minimize the time associated with reflowing 160, it is preferred that reflowing be accomplished using a means for rapidly heating the noble metal preform. Rapid heating may be accomplished by irradiating the noble metal preform with a laser or an electron beam. While it is expected that many types industrial lasers may be utilized in accordance with the present invention, including those having a single point shape at the focal plane, it is preferred that the beam have a distributed area or beam shape at the focal plane. An example of a suitable laser for noble metal alloys of the type described herein is a multi-kilowatt, high power, direct diode laser having a generally rectangular-shaped beam at its focal plane of approximately 12 mm by 0.5 mm. Depending on the size of the preform compared to the size of the beam and other factors, such as the desired heating rate, thermal conductivity and reflectivity of the noble metal preform and other factors which influence the heating and/or melting characteristics of the noble metal preform, the laser may be held stationary with respect to the electrode and noble metal preform or rastered or scanned across the surface of the noble metal preform in any pattern that produces the desired heating/reflowing result for the noble metal preform 46. It is generally preferred that the beam of the laser have substantially normal incidence with respect to the surface of the electrode and/or the noble metal preform. In addition, the electrode may be rotated with respect to the beam of the laser. As an alternative or addition to scanning or rastering the beam of the laser, the electrode may be scanned or rastered with respect to the beam of the laser. It is believed that similar techniques to create relative movement between the electrode/noble metal preform and the beam may be employed if a focused electron beam is utilized for the step of reflowing 160. In addition, any other suitable means of rapidly heating the noble metal preform, such as various high-intensity, near-infrared heaters may be employed so long as they are adapted to reflow the alloy preform 46 employed and may be controlled to limit undesirable heating of electrode 16,18.

It is further preferred that the heating of the noble metal preform/electrode be limited to the preform as much as possible, so as to avoid melting portions of the electrode. A polished metal mask which is adapted to expose the noble metal preform and mask electrode and which is particularly adapted to reflect the wavelength of the laser radiation used may be employed. In the case of the diode laser described above, it is preferred that the metal mask comprise polished aluminum or copper or alloys thereof.

Figure 14:
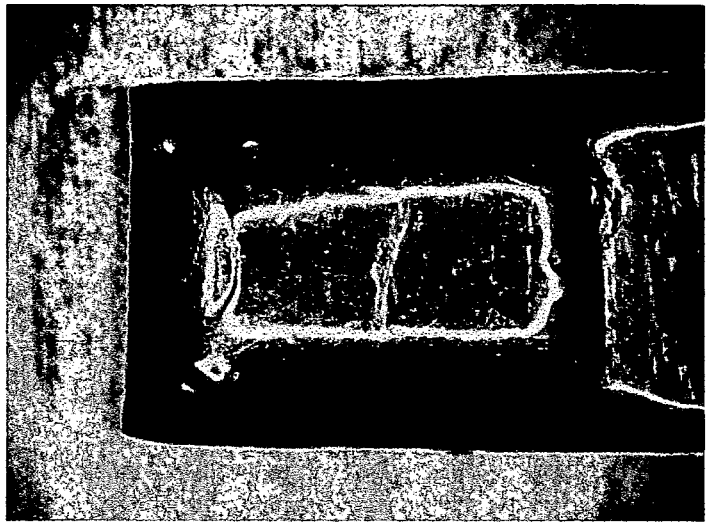
FIG. 14 is a photograph of a ground electrode of the present invention.

The step of forming 180 the reflowed noble metal firing tip 20,22 may utilize any suitable method of forming the firing tip, such as, for example, stamping, forging, or other known metal forming methods and machining, grinding, polishing and other metal removal/finishing methods. FIGS. 10 and 12 illustrate a center electrode 20 to which forming 180 was applied by grinding and polishing to shape the firing surface 21. Similarly, FIG. 14 illustrates forming 180 by grinding and polishing the firing surface 23 of a ground electrode 22.

Figure 24:
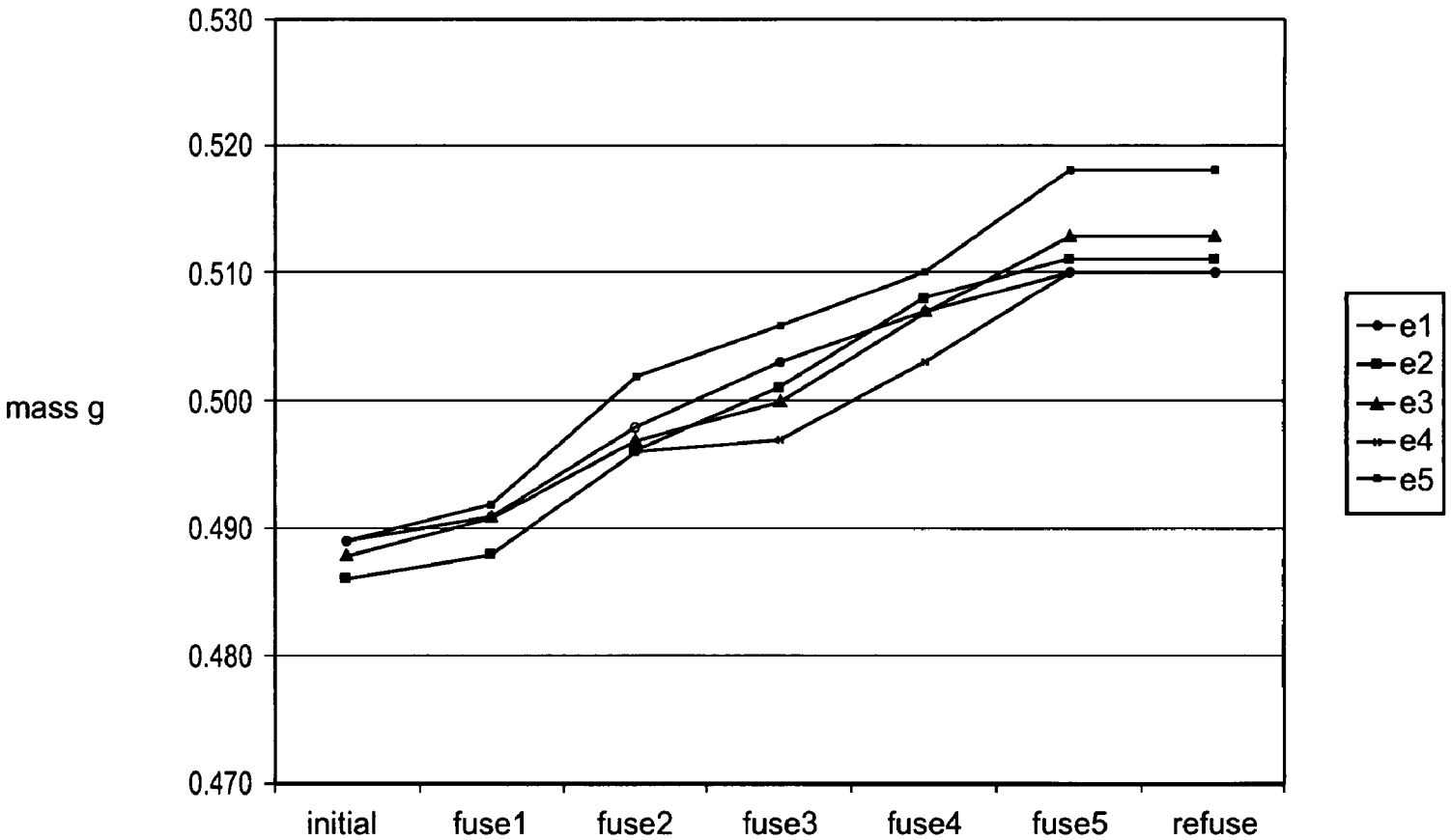
FIG. 24 is a plot of the weight of a various electrodes as a function of the repetition of steps 140 and 160 of the invention.

The steps of applying 140 the alloy preform and reflowing 160 may be repeated as shown in FIGS. 23A-23E in conjunction with method 100 for a plurality of iterations to add material to firing tip 20,22. FIG. 24 illustrates that the weight increase may be generally linear as these steps are repeated. The layers of material added may be of the same composition or may have a different composition such that the coefficient of thermal expansion (CTE) is varied through the thickness, the CTE of the layers proximate the electrode being closer to that of the electrode and the CTE of the outer layers being that of the noble metal alloy desired at the firing surface 21,23 of the firing tip 20,22. Similarly, this multilayer approach could be used to implement diffusion barriers or various composite structures and the like into firing tip 20,22 to inhibit diffusion through the tip or provide various structural or performance features, respectively.

The invention may be further understood with reference to the following representative examples.

EXAMPLE 1

Example 1 was directed to the development of a coat and fuse/reflow process for ground electrodes. The objective of the tests related to example 1 was to fuse/reflow pure iridium powder on the end of material commonly used as ground electrode bars for sparkplug applications. The metal material selected as a representative ground electrode material was an Inconel alloy (836 alloy). The noble metal material used as the alloy preform was an iridium powder (−325 mesh) obtained from Alfa Aesar. The alloy preform was applied to the electrode as an aqueous slurry of the Ir powder and an aqueous solution of polyvinyl alcohol and water. The polyvinyl alcohol (PVA) served as a binder agent to attach the powder particles to themselves and the surface of the electrode. The apparatus used to reflow the noble metal preform was a 4 kW diode laser made by Nuvonyx. The electrode was placed in a reflective copper mask fixture to hold the electrodes and control the application of the laser energy, such that only the noble metal preform was exposed to the beam of the laser. The test samples were then examined using optical microscopy. The method of forming the noble metal electrode tips was as follows:

1. Mix small quantity of iridium powder with polyvinyl alcohol solution and deposit a preform of the slurry on the end of a weighed ground electrode.
2. Dry the slurry using an infrared convection apparatus.
3. Reweigh electrodes with the dry slurry.
4. Place the coated electrode in the copper mask fixture.
5. Apply the laser energy and fuse/reflow the preform with Nuvonyx diode laser at focus, 4 kW (100%) power, while applying a 30SCFH argon shield gas with nozzle delivery, with scan speed as listed in the table below.
6. Reweigh the pin after fusing.

Tables 1 and 2 illustrate the variables introduced into the test samples, as well as the results of the test.

TABLE 1

| Electrode | Laser scan speed m/min | Direction |
|---|---|---|
| 1 | 1 | Middle to end |
| 2 | 1 | End to middle |
| 3 | 1 | End to middle |
| 4 | 0.5 | End to middle |
| 5 | 0.75 | End to middle |

TABLE 2

| Electrode | Wt before (g) | Wt + dry slurry (g) | Wt fused (g) |
|---|---|---|---|
| 1 | 0.732 | 0.747 | 0.740 |
| 2 | 0.729 | 0.748 | 0.741 |
| 3 | 0.731 | 0.767 | 0.761 |
| 4 | 0.738 | 0.763 | 0.762 |
| 5 | 0.736 | 0.757 | 0.756 |

The iridium was reflowed onto the Inconel ground electrodes using a slotted reflective copper fixture and a scanned laser. The best results using this apparatus were obtained when the scan started at the electrode end and moved toward the middle. This avoided the accumulation of a non-uniform portion of the reflowed noble metal material at the electrode tip. Between 8-30 mg of iridium remained after fusing and 1-7 mg of iridium was lost during the reflow process. Based on these results, it is believed that the use of a reflective a copper mask with a predetermined mask pattern together with a complementary preform and/or electrode (e.g. recess) may be used to control the shape of the reflowed firing tip. The scan direction and/or pattern is important to avoid the creation of non-homogeneities in the reflowed noble metal layer upon resolidification of the melt which occurs during the reflow process.

EXAMPLE 2

Example 2 was directed to the development of a coat and fuse/reflow process for center electrodes. The objective of the tests related to example 2 were to fuse/reflow a powder mixture of iridium, rhodium and tungsten powders on the end of material commonly used as the center electrode for sparkplug applications. The metal material selected as a representative center electrode material was a nickel cylindrical pin, 3.75 mm in diameter. The powder constituents used as the alloy preform comprised iridium powder (−325 mesh) obtained from Alfa Aesar, rhodium powder (−325 mesh) obtained from Alfa Aesar and tungsten powder (−325 mesh) obtained from Alfa Aesar. The alloy preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a rotatable copper mask fixture to hold electrodes and control the application of the laser energy, such that only the noble metal preform was exposed to the beam of the laser. A DC electric motor was used to control the rotation of the mask and electrode. The test samples were then examined using optical microscopy. The method of forming the noble metal electrode tips was as follows:

I. Preparing and Applying Slurry

1. Weigh nickel electrodes as received.
2. Mix Ir, Rh and W powders with polyvinyl alcohol solution in the following weights:

| | |
|---|---|
| W | 0.020 g |
| Ir | 0.782 g |
| Rh | 0.201 g |
| PVA solution | 0.333 g |

3. Deposit a preform of slurry on the end of each nickel pin
4. Air dry in lab then place in convection oven at 80° C. for approximately 1 hour.
5. Weigh pins with slurry dried on ends.

II. Reflowing Dried Slurry Preform

1. Fuse/reflow coated electrodes in spinning copper fixture (motor at 17.9V, 0.1A, approximately 600 rpm) with 1 second duration laser pulse. All laser shots at focus, 30SCFH nozzle delivered argon shield gas, laser power 4 kW
2. Re-polish copper mask surfaces after each fusing
3. Weigh each fused electrode and record the result as shown in Table 3.

TABLE 3

| Electrode # | Wt/g | Wt + dried slurry/g | Wt fused/g |
|---|---|---|---|
| 1 | 2.431 | 2.476 | 2.435 |
| 2 | 2.422 | 2.446 | 2.438 |
| 3 | 2.433 | 2.452 | 2.442 |
| 4 | 2.429 | 2.459 | 2.447 |
| 5 | 2.444 | 2.481 | 2.467 |
| 6 | 2.423 | 2.456 | 2.444 |
| 7 | 2.430 | 2.463 | 2.450 |
| 8 | 2.425 | 2.471 | 2.426 |
| 9 | 2.422 | 2.460 | 2.447 |
| 10 | 2.433 | 2.466 | 2.456 |
| 11 | 2.431 | 2.470 | 2.457 |
| 12 | 2.427 | 2.458 | 2.449 |
| 13 | 2.447 | 2.481 | 2.469 |
| 14 | 2.434 | 2.470 | 2.457 |
| 15 | 2.434 | 2.472 | 2.460 |
| 16 | 2.448 | 2.485 | 2.470 |
| 17 | 2.436 | 2.469 | 2.458 |
| 18 | 2.428 | 2.481 | 2.428 |
| 19 | 2.431 | 2.479 | 2.459 |
| 20 | 2.447 | 2.497 | 2.467 |

Figure 15:
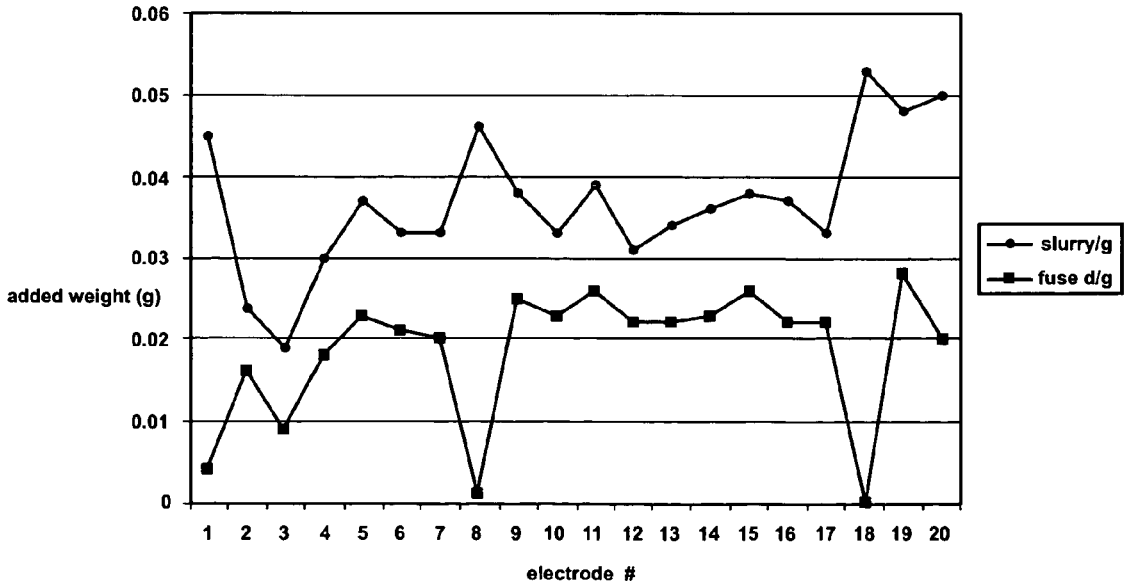
FIG. 15 is a plot of the weight of a number of electrodes of the present invention both before and after reflowing of the noble metal preform.
Figure 16A:
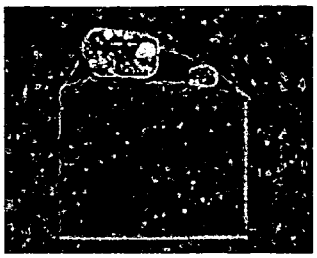
FIGS. 16A through 16E are optical photomicrographs of metallographic sections of a center electrode of the present invention having a firing tip reflowed for different time intervals.
Figure 16B:
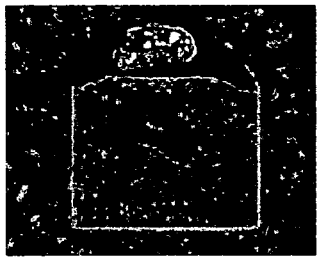
Figure 16C:
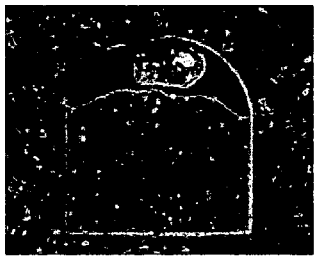
Figure 16D:
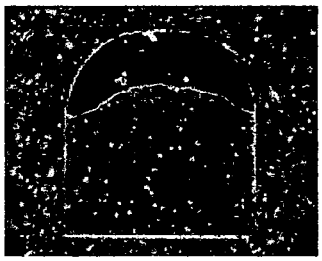
Figure 16E:
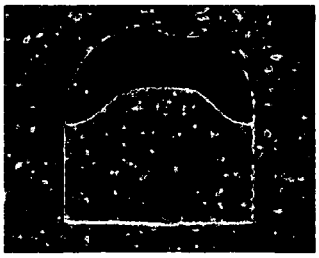
Figure 17A:
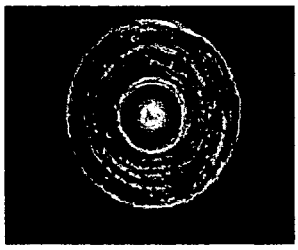
FIG. 17A is a top view photograph of an electrode of the present invention.
Figure 17B:
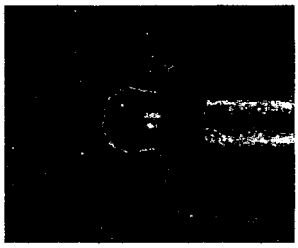
FIG. 17B is a side view photograph of the electrode of FIG. 17 A.
Figure 17C:
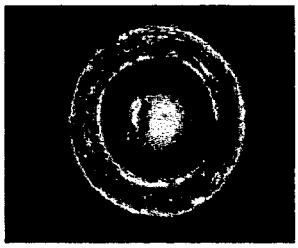
FIG. 17C is a top view photograph of an electrode of the present invention.
Figure 17D:
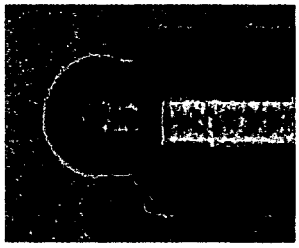
FIG. 17D is a side view photograph of the electrode of FIG. 17 A.
Figure 17E:
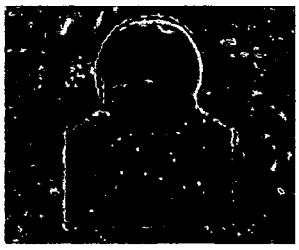
FIG. 17E is an optical photomicrograph of a metallographic section of an electrode of the type of FIG. 17C.

Electrodes 1, 8 and 18 were among those with the most slurry added but with least material remaining after fusing. Thus, it appears that the amount of material and/or size of the preform utilized should be controlled to an optimum amount depending on the application. For the test electrode/preform configuration used, on average, around 20 mg of Ir/Rh/W remained fused after the reflow process. Electrodes 5 and 9-17 were the ten most consistent samples (closest to average). Based on these results, it is believed that too much slurry causes material to be ejected from the melt, thus an optimum size/amount of material should be selected for the preform, depending on the application, in order to minimize the loss of the noble metal during the reflow process. For the electrode configuration used in this test, about 35 mg of dried slurry on the 3.75 mm electrode tip before laser reflow, appears to be an optimum amount. Electrodes 19 and 20 were not representative of the rest, since the remains of the slurry were used to coat these samples. The slurry was more viscous due to evaporation of the PVA solution and settling of the metal powder during coating of the other electrodes, even though regular stirring occurred between each coating operation. FIG. 15 illustrates the results of this example.

EXAMPLE 3

Example 3 was directed to the development of a coat and fuse/reflow process for center electrodes. The objective of the tests related to example 3 were to fuse/reflow a powder mixture of iridium, rhodium and tungsten powders on the end of material commonly used as the center electrode for sparkplug applications without resulting inclusions or defects. The metal material selected as a representative center electrode material was a pure nickel cylindrical pin, 3.75 mm in diameter. The powder constituents used as the alloy preform comprised iridium powder (−325 mesh) obtained from Alfa Aesar, rhodium powder (−325 mesh) obtained from Alfa Aesar and tungsten powder (−325 mesh) obtained from Alfa Aesar. The alloy preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a rotatable copper mask fixture to hold electrodes and control the application of the laser energy, such that only the noble metal preform was exposed to the beam of the laser. A DC electric motor was used to control the rotation of the mask and electrode. The test samples were then examined using optical microscopy. The method of forming the noble metal electrode tips was as follows:

I. Preparing and Applying Slurry

1. Mix Ir, Rh and W powders with polyvinyl alcohol solution in the following weights:

| | |
|---|---|
| W | 0.019 g |
| Ir | 0.778 g |
| Rh | 0.199 g |
| PVA solution | 0.319 g |

2. Deposit a preform of slurry on the end of each nickel pin
3. Air dry in lab then place in convection oven at 80° C. for approximately 1 hour.

II. Fusing Dried Slurry

1. Reflow coated electrodes in spinning copper fixture (motor at 17.9V, 0.1 A, approximately 600 rpm) with laser pulses of varying duration (0.5 s, 0.6 s, 0.7 s, 0.8 s and 1.0 s).
2. All laser shots at focus, 30SCFH nozzle delivered argon shield gas, laser power 4 kW
3. Repolish copper mask surfaces after each fusing.

III. Section and Polish Samples for Optical Microscopy.

As may be seen from FIGS. 16A-E, for the combination of electrodes/noble metal preform/laser power/etc. selected, inclusions were present in fused electrodes produced with laser shots between 0.5 s and 0.8 s. Longer laser shots (i.e., more laser energy) improved melt homogeneity. Inclusions were absent on electrodes irradiated for 1 s. Thus, it is believed that longer laser shots (i.e., greater amounts of laser energy) increase melt mixing and homogeneity. Laser shots <0.8 s did not provide enough energy to fully melt and mix the iridium/rhodium/tungsten with the nickel substrate, thus, for a given combination of electrode/noble metal preform/laser power, there exists a minimum amount of energy that must be supplied in order to fully melt the preform and obtain a homogeneous firing tip on the electrode. It is preferred that the laser exposure for the combination of materials selected for the test is at least 1 s. Thus, the sample exposed for 1 sec. experienced approximately 10 revolutions under the beam.

EXAMPLE 4

Example 4 was directed to the development of a coat and fuse/reflow process for center electrodes. The objective of the tests related to example 4 were to fuse/reflow a powder mixture of iridium, rhodium and tungsten powders on the end of material commonly used as the center electrodes of sizes typically used in automotive and industrial sparkplug applications. The metal material selected as a representative for an industrial center electrode material was a nickel cylindrical pin, 3.75 mm in diameter. Other automotive electrodes were also turned to diameters of 0.030 in and 0.060 in. The powder constituents used as the alloy preform comprised iridium powder (−325 mesh) obtained from Alfa Aesar, rhodium powder (−325 mesh) obtained from Alfa Aesar and tungsten powder (−325 mesh) obtained from Alfa Aesar. The alloy preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a rotatable copper/aluminum mask fixture to hold the electrodes and control the application of the laser energy, such that only the noble metal preform was exposed to the beam of the laser. A DC electric motor was used to control the rotation of the mask and electrode. The test samples were then examined using optical microscopy. The method of forming the noble metal electrode tips was as follows:

I. Preparing and Applying Slurry

1. Mix Ir, Rh and W powders with polyvinyl alcohol solution in the following weights:

| | |
|---|---|
| W | 0.019 g |
| Ir | 0.778 g |
| Rh | 0.199 g |
| PVA solution | 0.319 g. |

2. Deposit a preform of slurry on the end of each nickel pin.
3. Air dry in lab then place in convection oven at 80° C. for approximately 1 hour.

II. Weighing Parts

1. Weigh industrial electrodes before applying slurry, after slurry i s dried and after fusing.
2. Calculate average weight gains and losses due to coating and fusing.

III. Fusing Dried Slurry

1. Fuse 0.030" and 0.060" electrodes in stationary fixture with 300 ms and 500 ms single shots, respectively.
2. Fuse 3.75 mm industrial electrodes in spinning copper fixture (motor at 17.9V, 0.1 A) with a 700 ms laser shot.
3. All laser shots at focus, 30SCFH nozzle delivered argon shield gas, laser power 4 kW.
4. Repolish copper mask surfaces after each fusing.

IV. Section and Polish Selected Samples Before Optical and Electron Microscopy.

Some of the 0.030 in. electrodes did not fuse successfully and material was ejected from the tip when fused. However, it is believed that the process is applicable to this size electrode, and would simply require adjustment of the processing conditions to obtain satisfactory results. The 0.060" and 3.75 mm electrodes fused well. Iridium, rhodium and tungsten were distributed throughout the melt zone but in some cases inclusions were present. It is evident that various shapes (i.e. hemispherical) are possible due in part to the surface tension effects associated with the melt. Pores were present in the inclusions, however, it is believed that adjustment of the processing conditions and starting materials may be affected to obtain firing tips with no inclusions with sufficient melting of the preform. A thin layer of slag was present on regions of the fused surface and the slag contained titanium which may have been a contaminant in the powder of the preform, or introduced from another source of contamination. On average the slurry deposit was 37 mg on 3.75 mm electrodes. Approximately 8 mg of material was lost upon reflowing/fusing the powder preform. Approximately 30 mg of fused material remained on the 3.75 mm electrodes. Based on these results, it is believed that adjustment of process conditions or the starting materials is required to reflow Ir/Rh/W on 0.030" electrodes reproducibly. In some cases the coating material was expelled and the substrate was hardly fused. It is believed that the changing the laser pulse length, and distance from focus may be sufficient to obtain complete reflow and fusing of the noble metal preform and electrode. The laser parameters may be refined to reflow/fuse Ir/Rh/W on 3.75 mm and 0.060 electrodes, so that uniform melt mixing occurs and inclusions/pores are eliminated. Again, this will be a balance of the right pulse duration and distance from focus. Titanium in the slag is a contaminant which can be eliminated with more thorough process controls.

EXAMPLE 5

Example 5 was directed to the development of a coat and fuse/reflow process for center electrodes. The objective of the tests related to example 5 were to fuse/reflow an iridium powder on the end of material commonly used as the center electrodes of sizes typically used in automotive sparkplug applications. The ends of these nickel electrodes were turned to diameters of 0.030 in and 0.060 in. The powder constituent used as the noble metal preform comprised iridium powder (−325 mesh) obtained from Alfa Aesar. The noble metal preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a fixed copper/aluminum mask fixture to hold the electrodes and control the application of the laser energy, such that only the noble metal preform was exposed to the beam of the laser. The test samples were then examined using optical microscopy. The method of forming the noble metal electrode tips was as follows:

1. Mix a small quantity of Ir powder with polyvinyl alcohol solution and deposit a preform of slurry on the end of a nickel pin.
2. Dry the slurry using an infrared heating and convention apparatus.
3. Assemble the pin into the aluminum/copper mask fixture, note: the fixtures are similar for both electrode diameters—only the hole size in the copper differed.
4. Reflow/fuse with Nuvonyx diode laser with the following conditions: 4 kW (100%) power, at focus and stationary over electrode tip, 30SCFH argon shield gas, nozzle delivery:
   0.030" end diameter, 300 ms laser shot
   0.060" end diameter, 500 ms laser shot
5. Section, mount, polish and etch to reveal melt zone structure.

Referring to FIGS. 17A-17E, the aluminum/copper fixture confined the melt zone to the end of the electrodes without collapse of the machined tip of the electrode. Single laser shots with the beam stationary formed uniform hemispherical fused tips of iridium on 0.030" and 0.060" nickel electrodes. The iridium was fused with the nickel substrate without cracks or defects. Based on these results, it is believed that laser fused iridium powder/slurry on automotive nickel electrodes would form cost effective, metallurgically bonded, and crack-free surfaces for sparkplugs. Pores could be reduced or eliminated by thorough drying of the slurry coated bars in an oven (i.e., 80° C. for 2 hours). Three or four parts could be fused in a single laser exposure, since the beam area is approximately 14 mm×2 mm at 5 mm from focus. An array of parts could easily be treated in a few seconds. While the bond between the noble metal tip and the electrode is secure, adhesion of the fused tip to the substrate should be tested to ensure that the bond is sufficient to ensure that the firing tip survives engine use.

EXAMPLE 6

Figure 18A:
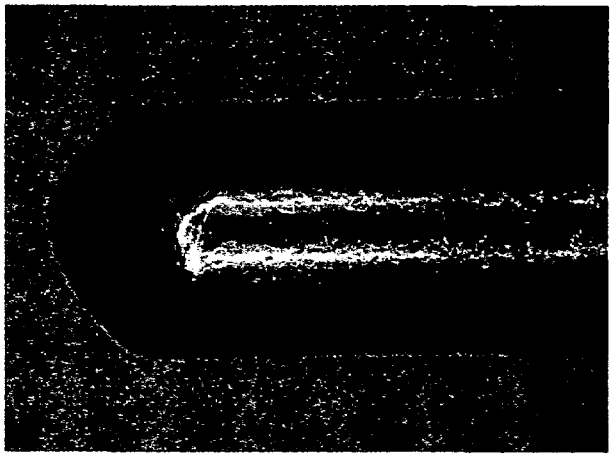
FIGS. 18A-B are side view photographs of two center electrodes of the present invention after reflowing of the noble metal preform, illustrating the effect of a scanned beam (18A) and a single shot, stationary beam with rotation of the electrode(18B)
Figure 18B:
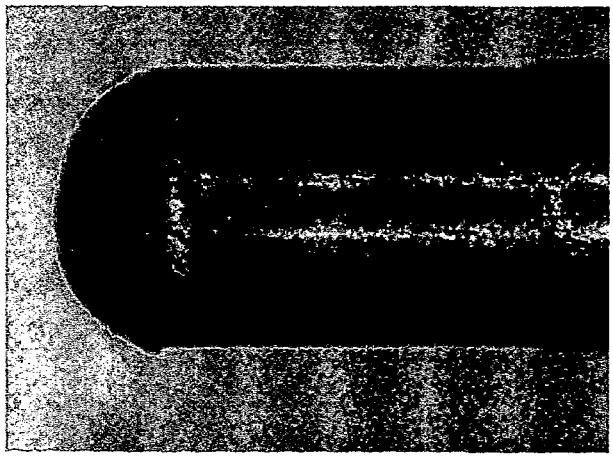
Figure 18C:
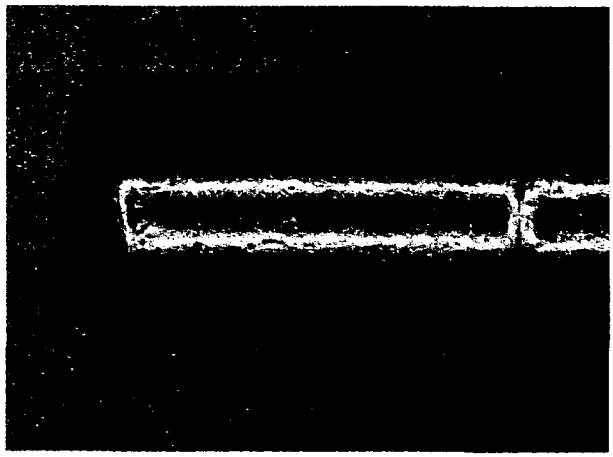
FIG. 18C is a side view photograph of a center electrode of the present invention after reflowing, followed by grinding and polishing of the firing tip.

Example 6 was directed to the development of a coat and fuse/reflow process for center electrodes. The objective of the tests related to example 6 were to fuse/reflow an iridium powder on the end of material commonly used as the center electrodes of sizes typically used in industrial sparkplug applications. The metal material selected as a representative center electrode material was a nickel cylindrical pin, 2.5 mm in diameter. The powder constituent used as the noble metal preform comprised iridium powder (−325 mesh) obtained from Alfa Aesar. The noble metal preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a fixed polished aluminum block mask fixture or a rotating Cu mask fixture to hold the electrodes and control the application of the laser energy, such that only the noble metal preform was exposed to the beam of the laser. The test samples were then examined using optical microscopy. The method of forming the noble metal electrode tips was as follows:

1. Mix small quantity of Ir powder with polyvinyl alcohol solution and deposit a preform of slurry on the end of a nickel pin.
2. Dry the slurry using an infrared heating and convention apparatus.
3. Assemble the pin into the polished aluminum block.
4. Laser fuse with Nuvonyx diode laser with the following conditions:
   - Sample 1, 4 kW, at focus, 1 m/min, Ar shield gas, fixed Al mask
   - Samples 2, 4 kW, at focus, 0.5 m/min, Ar shield gas, fixed Al mask
   - Sample 3, 4 kW, 5 mm from focus, single shot 0.75 s, Ar shield gas, rotating Cu mask
   - Samples 4, 4 kW, 5 mm from focus, single shot 0.5 s, Ar shield gas, rotating Cu mask
5. Grind and polish, if desired, see FIG. 18C.

As shown in FIGS. 18A-19B, the iridium powder melted and fused with the nickel substrate to form an iridium rich surface alloyed with nickel. Scanning the laser beam over the dried iridium slurry produced an uneven melt pool and an asymmetric fused surface. A single laser shot with the beam stationary and the part rotated formed a uniform hemispherical fused tip of iridium on nickel. Some pores were present, but the majority of the fused surface was pore free. No cracks were observed. Based on these results, it is believed that laser fused iridium powder/slurry on a nickel pin would be a cost effective, metallurgically bonded, crack-free electrode surface for sparkplugs. It is further believed that pores could be reduced or eliminated by thorough drying of the slurry coated bars in an oven (suggest 80° C. for 2 hours). Polished aluminum was a good mask fixture material, however polished copper would be better since it is more reflective ($R_{Al}$=0.71, $R_{Cu}$=0.90).

EXAMPLE 7

Example 7 was directed to the development of a coat and fuse/reflow process for center electrodes. The objective of the tests related to example 7 were to fuse/reflow a platinum powder on the end of material commonly used as the center electrodes of sizes typically used in automotive and industrial sparkplug applications. The metal material selected as a representative center electrode material were nickel cylindrical pins, 2.5 mm and 3.75 mm in diameter. The powder constituent used as the noble metal preform comprised platinum powder (−325 mesh) obtained from Alfa Aesar. The noble metal preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a fixed polished copper mask fixture to hold the electrodes and control the application of the laser energy, such that only the noble metal preform was exposed to the beam of the laser. The test samples were then examined using optical microscopy. The method of forming the noble metal electrode tips was as follows:

1. Mix small quantity of Pt powder with polyvinyl alcohol solution and deposit a blob of slurry on the end of a nickel pin.
2. Dry the slurry using an infrared heating and convention apparatus.
3. Assemble the pin in the chuck on the rotary stage. Mount copper mask at the end of the pin if required.
4. Laser fuse with Nuvonyx diode laser according to the following conditions.

TABLE 4

| Sample | FIG. No. | Diameter mm | Laser shots | Mask | Fdist mm |
|---|---|---|---|---|---|
| 1 | 20A, B | 2.5 | 0.5 | None | 0 |
| 2 | 20C | 2.5 | 0.5 | At tip | 0 |
| 3 | 20D | 2.5 | 0.5 | At tip | 10 |
| 4 | 20E | 3.75 | 0.5 | At tip | 10 |
| 5 | | 3.75 | 0.5 | At tip | 5 |
| 6 | | 3.75 | 0.7 | At tip | 7 |
| 7 | | 3.75 | 1.0 | At tip | 10 |

Referring to FIGS. 20A-E, a copper mask was required to prevent the melt zone form extending over the sides of the electrode. Setting the laser 10 mm from focus reduced the depth of the melt zone on the 2.5 mm electrode. No fusion mixing occurred at 10 mm from focus on the 3.75 mm electrodes with both 0.5 s and 1.0 s laser shots. Fused zones were observed on the 3.75 mm electrodes at focus+5 mm and focus+7 mm, but non-fused regions were also present on the ends of both. An increase in distance from focus increased the size of the melt zone on the 3.75 mm electrodes but at 10 mm from focus there was no fusion with the substrate. Based on these results, it is believed that better drying (oven at 80° C., 1 hour) may reduce defects, dips and pores. Small electrodes (2.5 mm or less) can be fused with a single laser shot. Larger electrodes (3.75 mm+) may require rotation of the electrode and/or mask to fuse the whole of the top surface. An increase in distance from focus produces a larger fusion zone but at 10 mm from focus the irradiance (W/cm2) is too low to fuse the coating with the substrate. Melt depth, extent of mixing and porosity as a function of distance from focus and shot duration (scan speed for larger electrodes) may be important parameters for controlling the reflow process so as to produce fully dense coatings of the noble metal on the firing tip. It is believed that these results are also applicable to other noble metal powders, including iridium, rhodium, palladium, osmium, as well as gold and silver; platinum was used to conserve the other more expensive metal powders.

EXAMPLE 8

Example 8 was directed to the development of a coat and fuse/reflow process for center electrodes. The objective of the tests related to example 8 were to fuse/reflow a platinum or iridium powder on the end of material commonly used as the center electrodes of sizes typically used in industrial sparkplug applications. The metal material selected as a representative center electrode material was a nickel cylindrical pin, 3.75 mm in diameter. The powder constituent used as the noble metal preform comprised a mixture of platinum powder (−325 mesh) or iridium powder (−325 mesh), both obtained from Alfa Aesar. The noble metal preform was applied to the electrode as an aqueous slurry of the powder and an aqueous solution of polyvinyl alcohol and water. The polyvinyl alcohol served as a binder agent to attach the powder particles to themselves and the surface of the electrode. The apparatus used to reflow the noble metal preform was a 4 kW diode laser made by Nuvonyx. The electrode was placed in a rotating polished copper mask fixture to hold the electrodes and control the application of the laser energy, such that only the noble metal preform was exposed to the beam of the laser. The test samples were then examined using optical microscopy. The method of forming the noble metal electrode tips was as follows:

1. Mix small quantity of Pt or Ir powder with polyvinyl alcohol solution and deposit a blob of slurry on the end of a nickel pin.
2. Dry the slurry using hairdryer.
3. Assemble the pin in the fixture and, if required, set the DC motor rotating.
4. Laser fuse with Nuvonyx diode laser according to the conditions shown in Table 5. All laser treatments done at 4 kW, 30SCFH argon shield gas delivered by nozzle. The drilled end specimen had a cone shaped recess or well to accept precious metal slurry. 9V/0.08A corresponds to 5 rotations per second.
5. Produce polished sections of selected specimens and etch with 3% nital to reveal structure of melt zone.

TABLE 5

| Specimen ID | FIG. No. | Laser shots | Motor Volts/ Amps | Comments |
|---|---|---|---|---|
| 1 | | 0.5 | 17.9/0.1 | Pt, flat electrode, spin in beam |
| 2 | 21A | 0.7 | 17.9/0.1 | Pt, flat electrode, spin in beam |
| 3 | | 0.5 | 9/0.08 | Pt, flat electrode, spin in beam |
| 4 | | 0.7 | 9/0.08 | Pt, flat electrode, spin in beam |
| 5 | | N/A | N/A | Pt, no spin, scan 0.5 m/min |
| 6 | 21B | 0.5 | 9/0.08 | Pt, drilled end, spin in beam |
| 7 | | 0.7 | 17.9/0.1 | Ir, flat electrode, spin in beam |
| 8 | | 0.7 × 2 shots | 17.9/0.1 | Ir, flat electrode, spin in beam |

TABLE 6

| | Weight of Pt added through coat & fuse | | | |
|---|---|---|---|---|
| Specimen ID | Pin g | Pin + slurry g | Fused wt g | Fused Pt g |
| 5 | 2.430 | 2.470 | 2.440 | 0.010 |
| 6 | 2.395 | 2.435 | 2.412 | 0.017 |

Note: Specimen 1 ejected a ball of platinum from the melt, which weighed 0.033 g

TABLE 7

| | Weight of Ir added through coat & fuse | | | |
|---|---|---|---|---|
| Specimen ID | Pin g | Pin + slurry g | Fused wt g | Fused Ir g |
| 7 | 2.439 | 2.486 | 2.478 | 0.039 |
| 8 | 2.431 | 2.489 | 2.484 | 0.053 |

Note: Some specimens were weighed before slurry was applied, after slurry was applied and after fusing to determine material loss and weight of fused deposit.

Figure 21A:
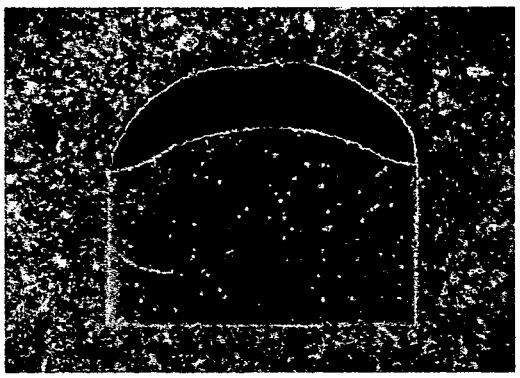
FIG. 21A is an optical photomicrograph of a metallographic section of a center electrode and firing tip of the present invention, showing the resultant shape of the electrode/firing tip interface following the reflow of an alloy preform on a flat ended electrode.
Figure 21B:
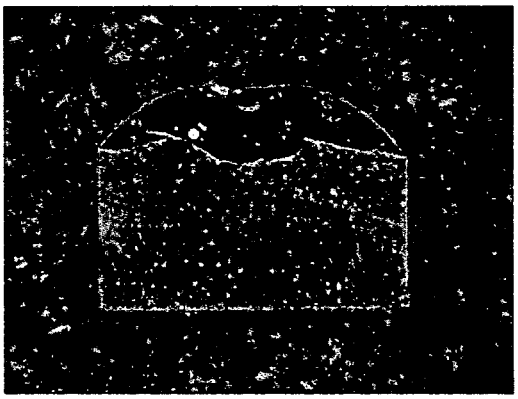
FIG. 21B is an optical photomicrograph of a metallographic section of a center electrode and firing tip of the present invention, showing the resultant shape of the electrode/firing tip interface following the reflow of an alloy preform on an electrode having a frusto-conical recess formed therein prior to the reflow.
Figure 22:
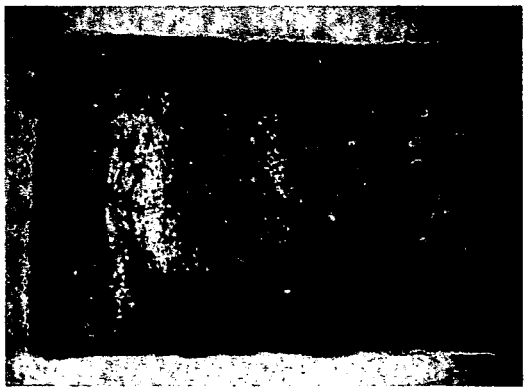
FIG. 22 is an optical photograph of a Ni alloy ground electrode having a single layer Ir firing tip reflowed thereon.
Figure 23A:
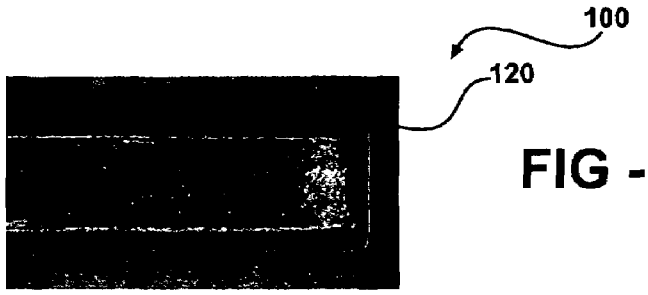
FIGS. 23A-23E are optical photographs of a ground electrode illustrating the method 100 of the invention and the repetition of steps 140 and 160.
Figure 23B:
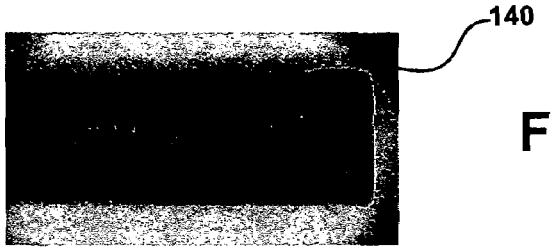
Figure 23C:
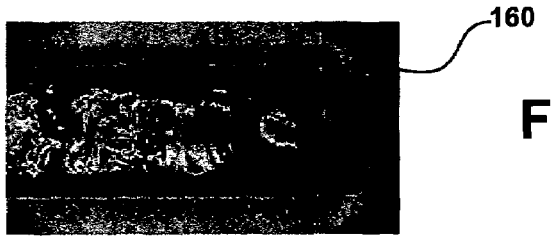
Figure 23D:
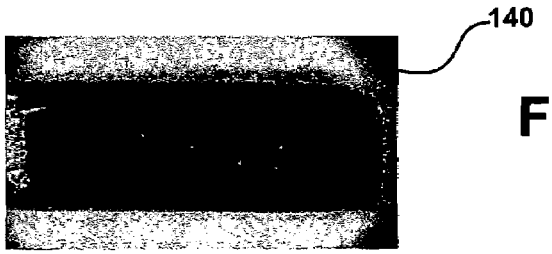
Figure 23E:
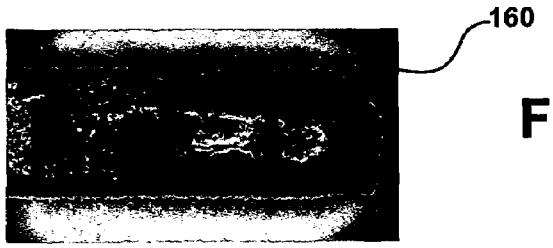

Scanning the beam over the slurry coated electrode gave an uneven fused surface. Spinning the part in the stationary beam gave a more even melt zone than scanning. Material was ejected from the platinum melt when rotated. A coating of 10 mg of platinum was fused to a flat ended electrode similar to that shown in FIG. 21A. Referring to FIG. 21B, a coating of 17 mg of platinum was fused to a pin with a drilled, hollowed out to accept slurry. Up to 53 mg of Ir remained on the rotating electrode when molten. Two laser shots did not improve the fused microstructure. Based on these results, it is believed that rotation is necessary to obtain a uniform melt zone on the 3.75 mm slurry coated electrode. Linear scanning of the beam over the stationary electrode surface should not be used as a fusing method. Thorough drying (i.e., oven at 80° C., 1 hour) may reduce defects, dips and pores.

It will thus be apparent that there has been provided in accordance with the present invention an ignition device and manufacturing method therefor which achieves the aims and advantages specified herein. It will, of course, be understood that the foregoing description is of preferred exemplary embodiments of the invention and that the invention is not limited to the specific embodiments shown. Various changes and modifications will become apparent to those skilled in the art. All such changes and modifications are intended to be within the scope of the present invention. The invention may be further described as follows:

The invention claimed is:

1. An ignition device for an internal combustion engine, comprising:

a housing;

an insulator secured within said housing and having an exposed axial end at an opening in said housing;

a center electrode mounted in said insulator and extending out of said insulator through said axial end, said center electrode having a firing end;

a ground electrode mounted on said housing and terminating at a firing end that is located opposite said firing tip such that said firing end and said firing tip define a spark gap therebetween; and a first firing tip formed from a first reflowed noble metal powder paste or slurry preform which is metallurgically bonded to one of said center electrode and said ground electrode at its firing end, said firing tip completely covering said firing end and an upwardly convex bond interface between said firing tip and said firing end.

2. The ignition device of claim 1, wherein the noble metal is selected from a group consisting of iridium, platinum, palladium, rhodium, gold, silver and osmium, and alloys thereof.

3. The ignition device of claim 2, wherein the noble metal also comprises a metal from the group consisting of tungsten, yttrium, lanthanum, ruthenium and zirconium as an alloying addition.

4. The ignition device of claim 1, further comprising a second firing tip formed from a second reflowed noble metal preform which is metallurgically bonded to the other of the respective ones of said center electrode and said ground electrode to which the first firing tip is bonded.

5. The ignition device of claim 4, wherein the preform is a powder preform.

6. The ignition device of claim 4, wherein the noble metal is selected from a group consisting of iridium, platinum, palladium, rhodium, gold, silver and osmium, and alloys thereof.

7. The ignition device of claim 6, wherein the noble metal also comprises a metal from the group consisting of tungsten, yttrium, lanthanum, ruthenium and zirconium as an alloying addition.

8. The ignition device of claim 4, wherein the firing tips are made of the same noble metal.

9. The ignition device of claim 1, wherein an upwardly convex bond interface exists between said firing tip and said firing end.

10. The ignition device of claim 1, wherein said firing tip has an outer surface which is a substantially flat plane.

11. The ignition device of claim 1, wherein said firing tip has an outer surface which is a substantially convex plane.

12. An ignition device for an internal combustion engine, comprising:

a housing;

an insulator secured within said housing and having an exposed axial end at an opening in said housing;

a center electrode mounted in said insulator and extending out of said insulator through said axial end, said center electrode having a firing end;

a ground electrode mounted on said housing and terminating at a firing end that is located opposite said firing tip such that said firing end and said firing tip define a spark gap therebetween; and a first firing tip formed from a first reflowed noble metal powder paste or slurry preform which is metallurgically bonded to one of said center electrode and said ground electrode at its firing end in a recess located therein and having an upwardly convex bond interface between said firing tip and said firing end.

13. The ignition device of claim 12, wherein the noble metal is selected from a group consisting of iridium, platinum, palladium, rhodium, gold, silver and osmium, and alloys thereof.

14. The ignition device of claim 13, wherein the noble metal also comprises a metal from the group consisting of tungsten, yttrium, lanthanum, ruthenium, hafnium and zirconium as an alloying addition.

15. The ignition device of claim 12, further comprising a second firing tip formed from a second reflowed noble metal preform which is metallurgically bonded to the other of the respective ones of said center electrode and said ground electrode to which the first firing tip is bonded.

16. The ignition device of claim 15, wherein the noble metal is selected from a group consisting of iridium, platinum, palladium, rhodium, gold, silver, and osmium, and alloys thereof.

17. The ignition device of claim 16, wherein the noble metal also comprises a metal from the group consisting of tungsten, yttrium, lanthanum, ruthenium and zirconium as an alloying addition.

18. The ignition device of claim 14, wherein the firing tips are made of the same noble metal.

19. The ignition device of claim 15, wherein said second firing tip is bonded in a second recess located at its respective firing end.

20. The ignition device of claim 19, wherein the preform is a powder preform.

21. The ignition device of claim 19, wherein the noble metal is selected from a group consisting of iridium, platinum, palladium, rhodium, gold, silver and osmium, and alloys thereof.

22. The ignition device of claim 21, wherein the noble metal also comprises a metal from the group consisting of tungsten, yttrium, lanthanum, ruthenium and zirconium as an alloying addition.

23. The ignition device of claim 12, wherein said firing tip has an outer surface which is a substantially flat plane.

24. The ignition device of claim 12, wherein said firing tip has an outer surface which is a substantially convex plane.

25. A method of manufacturing a metal electrode having an ignition tip for an ignition device, comprising the steps of:

forming a metal electrode having a firing tip portion;

applying a noble metal powder slurry or paste preform to the firing tip portion; and reflowing the noble metal powder slurry or paste preform to form a noble metal firing tip.

26. The method of 25, wherein the step of forming the electrode having a firing tip portion, further comprises the step of:

forming a recess in the firing tip portion of the electrode.

27. The method of claim 26, wherein the step of applying the noble metal preform to the firing tip portion, further comprises:

placing the noble metal preform into the recess formed in the firing tip portion.

28. The method of claim 25, wherein the noble metal powder paste or slurry comprises at least one constituent selected from the group consisting of a binder medium, a liquid carrier, an anti-microbial agent and an anti-fungal agent.

29. The method of claim 28, wherein the binder medium is an organic compound.

30. The method of claim 28, wherein the organic compound is polyvinyl alcohol.

31. The method of claim 25, wherein the noble metal is selected from a group consisting of iridium, platinum, palladium, rhodium, gold, silver and osmium, and alloys thereof.

32. The method of claim 31, wherein the noble metal also comprises a metal from the group consisting of tungsten, yttrium, lanthanum, ruthenium and zirconium as an alloying addition.

33. The method of claim 25, wherein reflowing is performed using energy obtained from a beam of a laser.

34. The method of claim 33, wherein the beam of the laser is focused and has a predetermined focal plane, and wherein the beam at the focal plane has a predetermined beam shape and focal area.

35. The method of claim 34, wherein the beam is scanned over the surface of the noble metal preform.

36. The method of claim 34, wherein the beam is stationary over the surface of the noble metal preform.

37. The method of claim 33, further comprising:

covering the electrode with a mask that is adapted to reflect the beam of the laser and has an opening that is adapted to expose at least a portion of the noble metal preform to the beam of the laser.

38. The method of claim 37, wherein the mask comprises aluminum.

39. The method of claim 37, wherein the mask comprises copper.

40. The method of claim 25, wherein reflowing is performed in air.

41. The method of claim 25, wherein reflowing is performed in an inert atmosphere.

42. The method of claim 25, wherein reflowing is performed using energy obtained from an electron beam.

43. The method of claim 42, wherein the electron beam is focused and has a predetermined focal plane, and wherein the beam at the focal plane has a predetermined beam shape and focal area.

44. The method of claim 43, wherein the beam is scanned with respect to the surface of the noble metal preform.

45. The method of claim 43, wherein the beam is stationary with respect to the surface of the noble metal preform.

46. The method of claim 25, further comprising a step of forming the firing tip following reflow of the preform.

* * * * *